US008099027B2

(12) United States Patent
Koshimori et al.

(10) Patent No.: US 8,099,027 B2
(45) **Date of Patent: *Jan. 17, 2012**

(54) DEVELOPER CONTAINING DEVICE AND IMAGE FORMING APPARATUS INTO/FROM WHICH DEVELOPER CONTAINING DEVICE IS INSTALLED AND REMOVED

(75) Inventors: Kazunori Koshimori, Saitama (JP); Hirokazu Murase, Ebina (JP)

(73) Assignee: Fuji Xerox Co., Ltd, Tokyo (JP)

( * ) Notice: Subject to any disclaimer, the term of this patent is extended or adjusted under 35 U.S.C. 154(b) by 658 days.

This patent is subject to a terminal disclaimer.

(21) Appl. No.: 12/115,941

(22) Filed: May 6, 2008

(65) Prior Publication Data

US 2009/0129826 A1 May 21, 2009

(30) Foreign Application Priority Data

Nov. 16, 2007 (JP) ..... 2007-298550

(51) Int. Cl.
*G03G 15/08* (2006.01)

(52) U.S. Cl. ..... 399/258; 399/120

(58) Field of Classification Search ..... 399/120, 399/258, 260, 262, 263
See application file for complete search history.

(56) References Cited

U.S. PATENT DOCUMENTS

| | | | | |
|---|---|---|---|---|
| 5,933,691 | A * | 8/1999 | Johroku | 399/262 |
| 6,292,644 | B1 | 9/2001 | Goto et al. | |
| 2006/0210319 | A1 | 9/2006 | Katsuyama | |
| 2007/0122205 | A1 * | 5/2007 | Taguchi et al. | 399/258 |

FOREIGN PATENT DOCUMENTS

| | | | |
|---|---|---|---|
| EP | 0843233 | B1 | 12/2002 |
| JP | 08-248754 | A | 9/1996 |
| JP | 09-281784 | A | 10/1997 |
| JP | 10142915 | A | 5/1998 |
| JP | 2000162861 | A | 6/2000 |

(Continued)

OTHER PUBLICATIONS

Notification of Reason for Refusal corresponding to Japanese Patent Application No. 2007-298550, dated Oct. 21, 2009.

(Continued)

*Primary Examiner* — David Gray
*Assistant Examiner* — Joseph Wong
(74) *Attorney, Agent, or Firm* — Sughrue Mion, PLLC

(57) ABSTRACT

A developer containing device includes: a developer container configured to contain developer and to be inserted into a receptacle defined in an image forming apparatus main body; a developer feed inlet provided in a forward end of the developer container which is inserted into the receptacle in an insertion direction and for feeding the developer contained in the developer container into the image forming apparatus main body; and an opening and closing member that opens the developer feed inlet with movement of the developer container in the insertion direction when the developer container is inserted into the receptacle and closes the developer feed inlet with movement of the developer container in opposition to the insertion direction when the developer container is removed from the receptacle, the opening and closing member having a protrusion formed to protrude inward of the opening and closing member and allowed to engage with a recess provided in the developer container and being arranged to be allowed to move on the outside of the developer container in a direction intersecting with the insertion direction of the developer container, and when the developer container is inserted into the receptacle, a developer container outside section sliding into the opening and closing member being brought to one side of the opening and closing member in the direction intersecting with the insertion direction of the developer container, then the protrusion being released from an engageable state.

11 Claims, 17 Drawing Sheets

FOREIGN PATENT DOCUMENTS

| | | | |
|---|---|---|---|
| JP | 2005-107141 | A | 4/2005 |
| JP | 2005-134452 | A | 5/2005 |
| JP | 2006-221079 | A | 8/2006 |
| JP | 2006-258928 | A | 9/2006 |

OTHER PUBLICATIONS

Australian Office Action dated Jan. 12, 2010 for Australian Patent Application 58507AUP00.

* cited by examiner

DEVELOPER CONTAINING DEVICE AND IMAGE FORMING APPARATUS INTO/FROM WHICH DEVELOPER CONTAINING DEVICE IS INSTALLED AND REMOVED

CROSS-REFERENCE TO RELATED APPLICATIONS

This application is based on and claims priority under 35 USC 119 from Japanese Patent Application No. 2007-298550 filed Nov. 16, 2007.

BACKGROUND

Technical Field

The present invention relates to a developer containing device and an image forming apparatus into/from which the developer containing device is installed and removed.

SUMMARY

An aspect of the invention resides in a developer containing device including: a developer container configured to contain developer and to be inserted into a receptacle defined in an image forming apparatus main body; a developer feed inlet provided in a forward end of the developer container which is inserted into the receptacle in an insertion direction and for feeding the developer contained in the developer container into the image forming apparatus main body; and an opening and closing member that opens the developer feed inlet with movement of the developer container in the insertion direction when the developer container is inserted into the receptacle and closes the developer feed inlet with movement of the developer container in opposition to the insertion direction when the developer container is removed from the receptacle, the opening and closing member having a protrusion formed to protrude inward of the opening and closing member and allowed to engage with a recess provided in the developer container and being arranged to be allowed to move on the outside of the developer container in a direction intersecting with the insertion direction of the developer container, and when the developer container is inserted into the receptacle, a developer container outside section sliding into the opening and closing member being brought to one side of the opening and closing member in the direction intersecting with the insertion direction of the developer container, then the protrusion being released from its engageable state.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described in detail with reference to the drawings.

Figure 1:
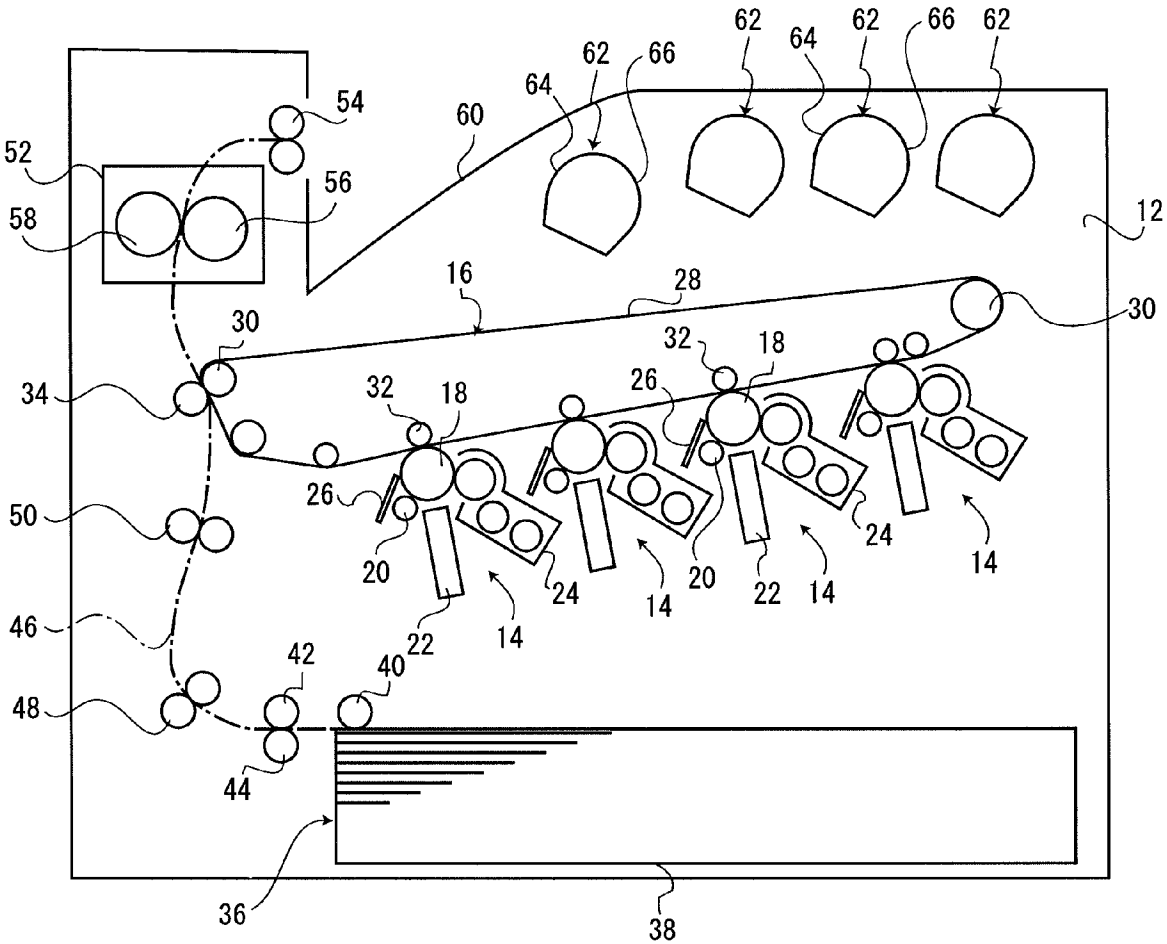
FIG. 1 is a side view depicting an image forming apparatus 10 in accordance with one exemplary embodiment of the invention.

FIG. 1 is a side view depicting an image forming apparatus 10 in accordance with one exemplary embodiment of the invention. The image forming apparatus 10 of FIG. 1 is the front side view of the image forming apparatus 10. Here, outer covering and the like are cleared, so the internal structure of the image forming apparatus 10 is revealed.

The image forming apparatus 10 has an apparatus main body 12 and, for example, four image forming units 14 and a transfer unit 16 are arranged inside the apparatus main body 12.

The image forming units 14 are four ones which are responsible for yellow, magenta, cyan, and black, respectively, and are arranged in parallel. Each of the image forming units 14 includes a photoreceptor 18 which is used as an image bearing body, a charging device 20 which is formed of, e.g., a roller for charging the photoreceptor 18 and other elements, an illumination device 22 which forms a latent image on the photoreceptor 18 with, e.g., a light emitting diode (LED), a development device 24 which develops the latent image on the photoreceptor 18, which has been formed by the illumination device 22, with developer, and a cleaning device 26 which cleans the photoreceptor 18 of developer particles remaining on the photoreceptor 18 after transfer.

The transfer unit 16 includes an intermediate transfer belt 28. The intermediate transfer belt 28 rotates clockwise in the figure and the belt is supported by plural supporting rollers 30. First transfer rollers 32 are positioned in abutting contact with the photoreceptors 18 with the intermediate transfer belt 28 running between each transfer roller and each photoreceptor. A second transfer roller 34 is positioned in abutting contact with one supporting roller 30 with the intermediate transfer belt 28 running between them.

In the lower part of the image forming apparatus main body 12, a paper feeder 36 is provided. The paper feeder 36 includes a paper tray 38 in which sheets of paper are stacked, a pickup roller 40 which pulls out a sheet from the paper stack in the paper tray 38, and a feed roller 42 and a retard roller 44 which feed a sheet, while separating one sheet from another.

Near one end of the image forming apparatus main body 12 (near the left end in the figure), a paper feeding path 46 extends along a substantially vertical direction. Along the paper feeding path 46, transport rollers 48, registration rollers 50, the second transfer roller 34, a fixing device 52, and eject rollers 54 are disposed. The registration rollers 50 once stop a sheet of paper being transported through the paper feeding path 46 and forward it to the second transfer roller 34 at a proper timing. The fixing device 52 has a heating roller 52 and a pressure roller 58 causing a developer image to be fused and fixed onto a sheet of paper by applying heat and pressure.

On the top of the image forming apparatus main body 12, a paper collector 60 is provided. A sheet of paper having a developer image fixed onto it is ejected by the above-mentioned eject rollers 54 to the paper collector 60 and ejected sheets of paper are stacked in the paper collector 60.

Four developer containing devices 62 are, for example, disposed above the intermediate transfer belt 28 and they contain yellow, magenta, cyan, and black developers, respectively. The developers contained in the developer containing devices 62 are supplied to the above-mentioned development devices 24 through developer feeding devices not shown, respectively. Each of the developer containing devices 62 has a developer container 64 in which the developer is contained. The developer containing devices 62, in each of which the developer container 64, a lid 68, a grasping member 70, and other elements, which will be described later, are integrally fabricated, are inserted into receptacles 66 defined in the image forming apparatus main body 12 from the front side to the rear side of the image forming apparatus 10.

Then, a developer containing device 62 is described in detail.

Figure 2:
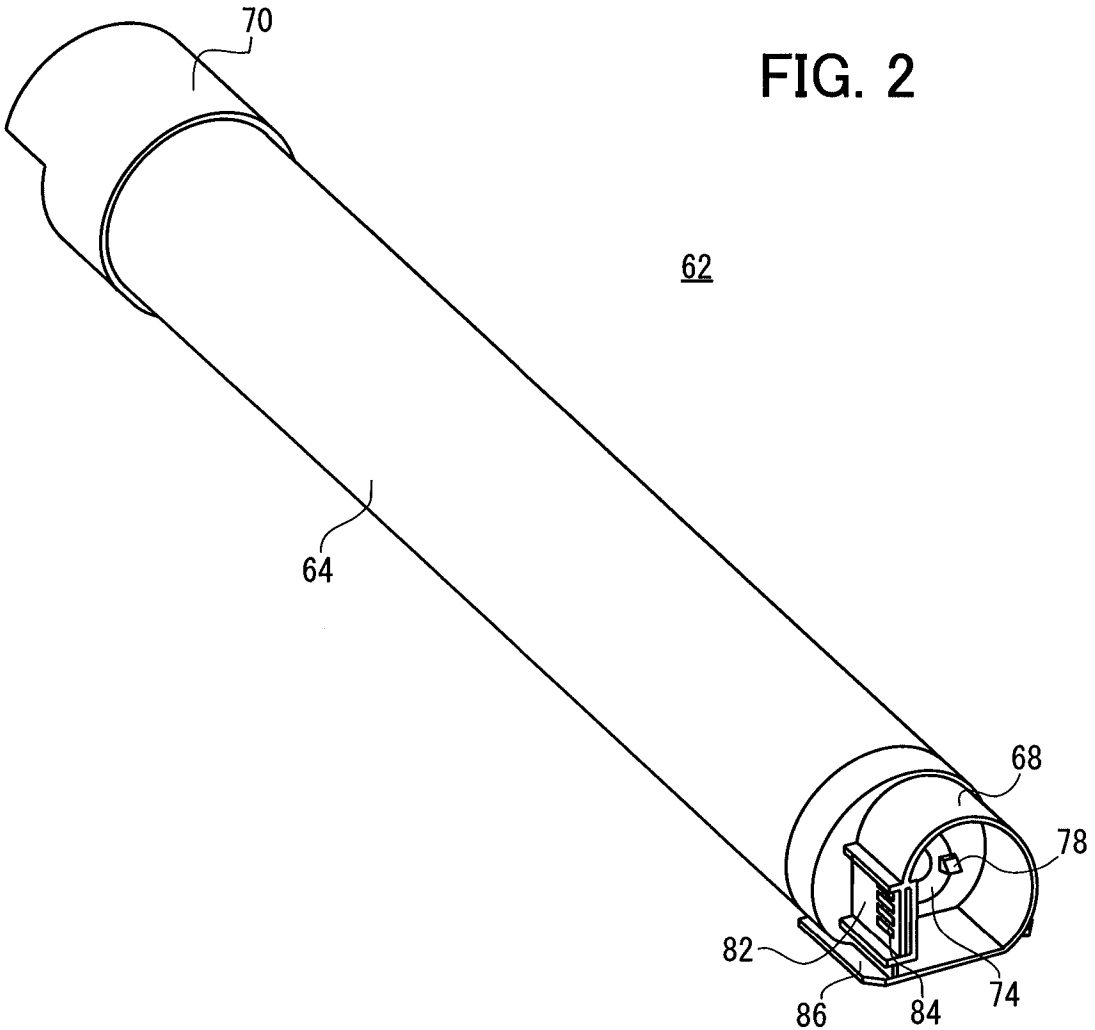
FIG. 2 is a perspective view depicting a developer containing device used in the exemplary embodiment of the invention.
Figure 3:
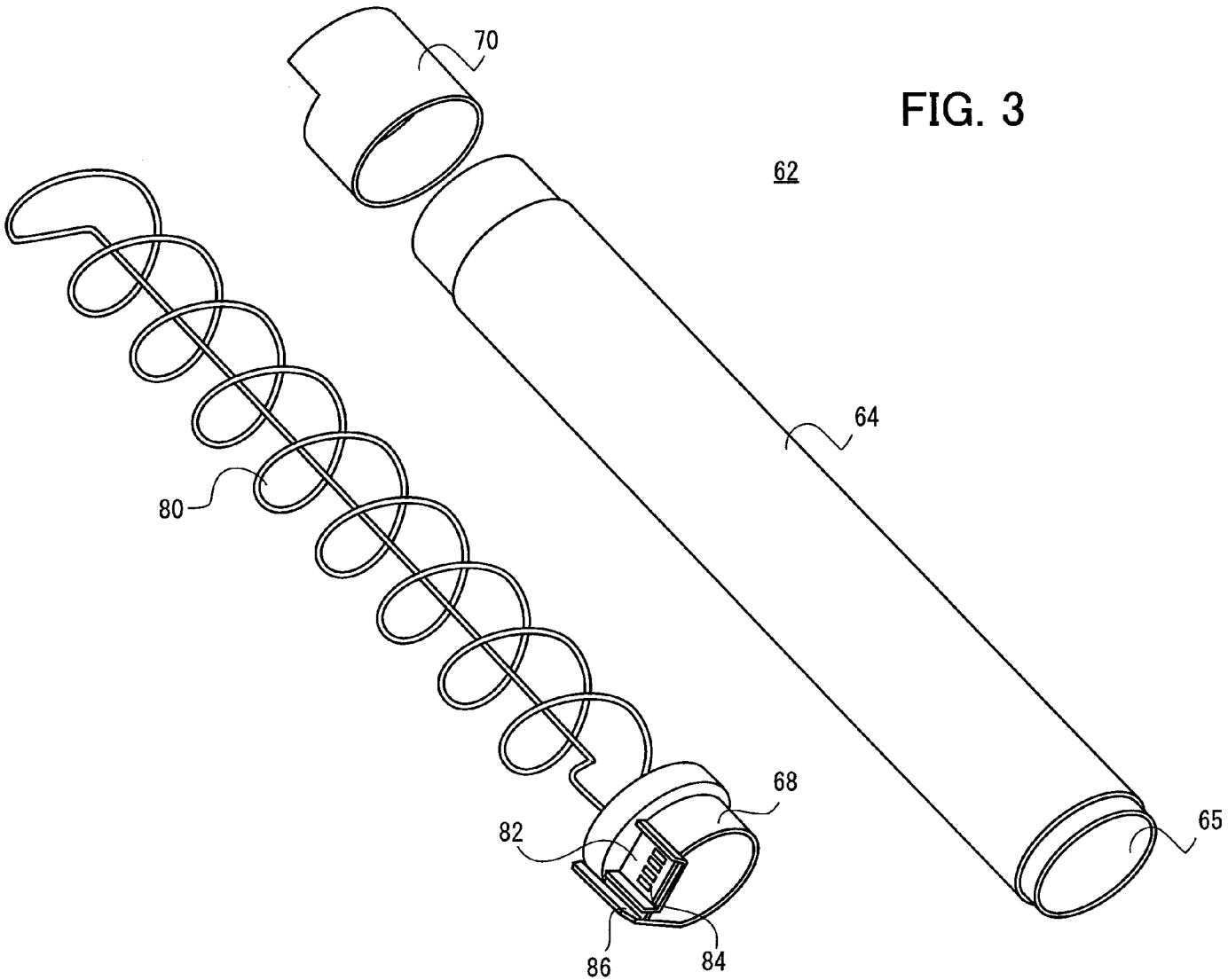
FIG. 3 is an exploded perspective view depicting a state in which the developer containing device used in the exemplary embodiment of the invention has been disassembled.
Figure 4:
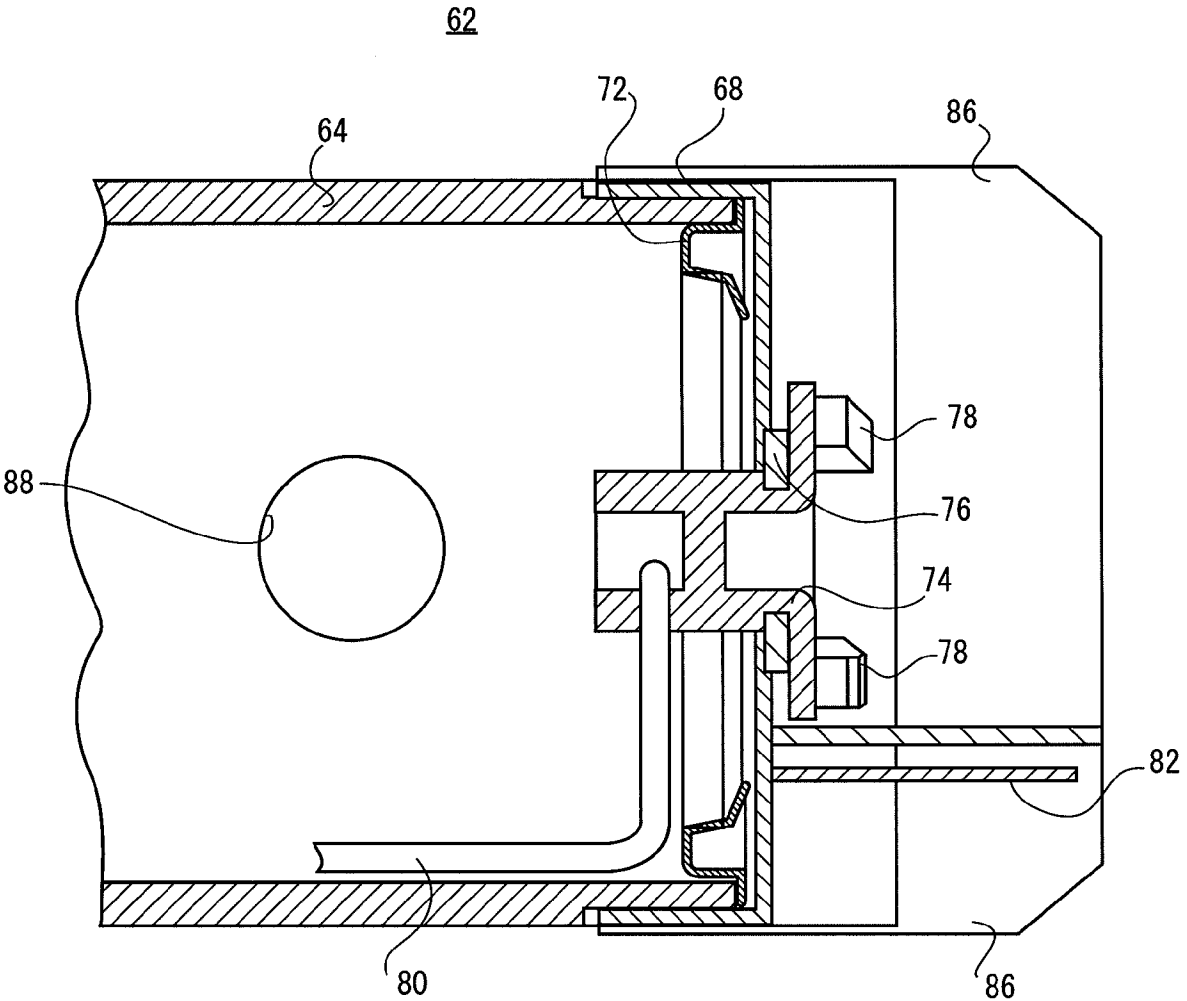
FIG. 4 is a cross sectional diagram depicting a part of the developer containing device used in the exemplary embodiment of the invention.
Figure 5:
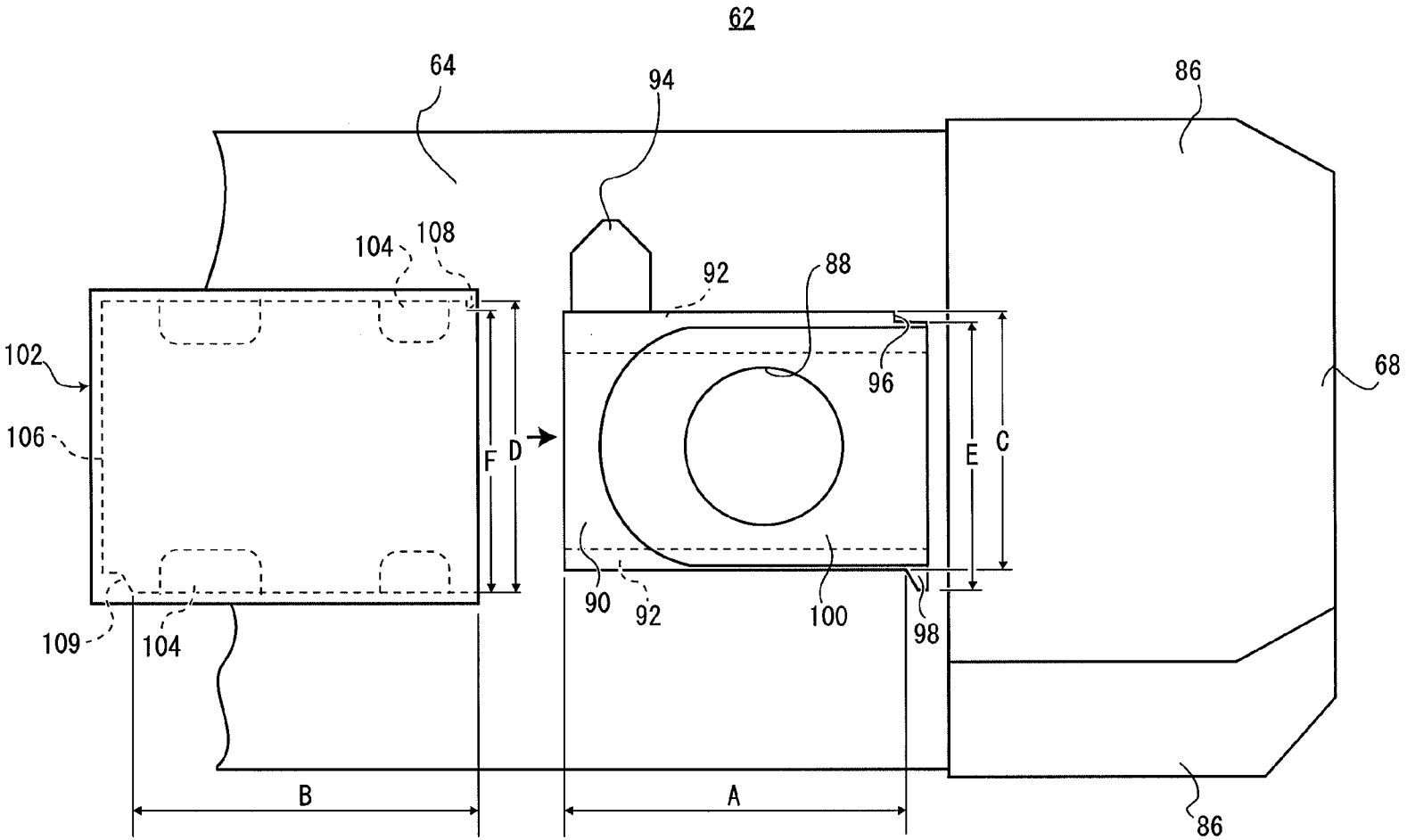
FIG. 5 is a bottom plan view depicting a part of the developer containing device used in the exemplary embodiment of the invention.
Figure 6:
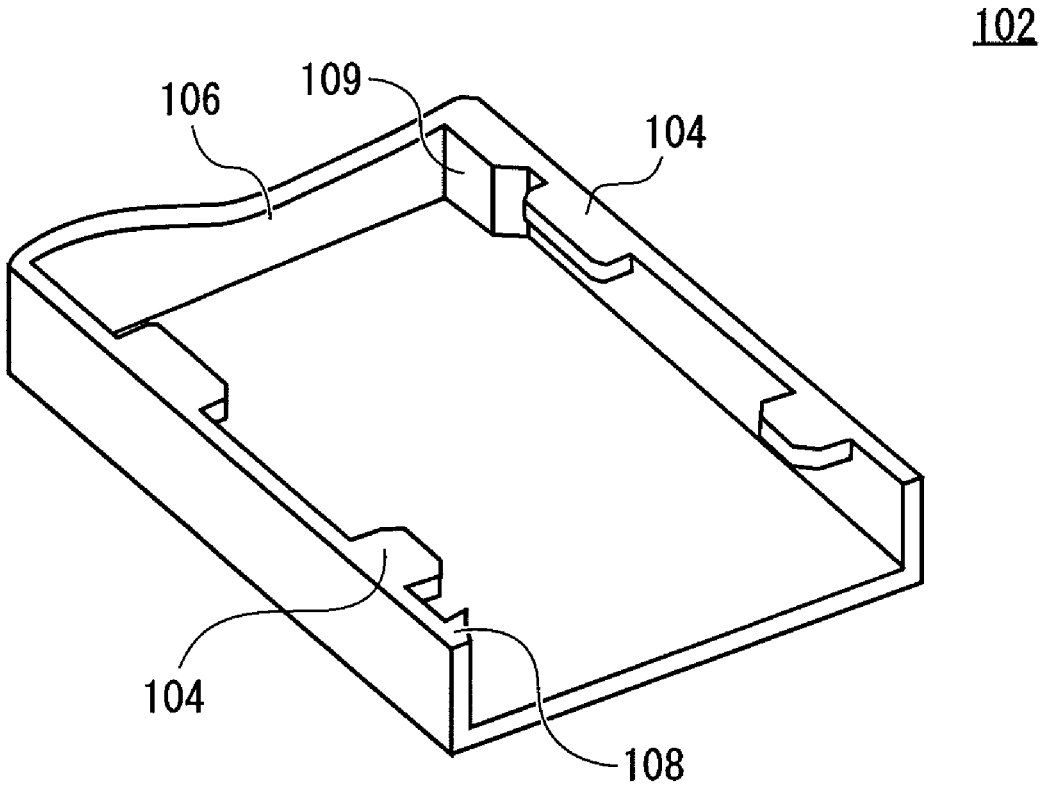
FIG. 6 is a perspective view depicting an opening and closing member used in the exemplary embodiment of the invention.

FIG. 2 is a perspective view depicting a developer containing device 62. FIG. 3 is an exploded perspective view depicting a state in which the developer containing device 62 has been disassembled. FIG. 4 is a cross sectional diagram depicting a part of the developer containing device 62. FIG. 5 is a bottom plan view depicting a part of the developer containing device 62. FIG. 6 is a perspective view depicting an opening and closing member.

The developer container 64 is substantially cylindrical, and its forward end in the direction of inserting it into its receptacle 66 of the image forming apparatus main body 12 is open and its rear end in the direction of inserting it into its receptacle 66 is closed. Its open end with regard to the insertion direction is closed by a lid 68 and developer is contained in a closed space defined by the developer container 64 and the lid 68. The grasping member 70 is fastened to the rear end of the developer container 64 with regard to the insertion direction. By holding the grasping member 70 by hand, it is possible to insert or remove the developer containing device 62 which is formed of the developer container 64 and other elements into/from the receptacle 66. Of the substantially cylindrical developer container 64, both the forward and rear ends in the direction of insertion into the receptacle 66 of the image forming apparatus main body 12 may be open and these open ends may be closed to define the closed space. In the case of doing so, its forward end of the developer container 64 with regard to the direction of insertion into the receptacle 66 is closed by the above-mentioned lid 68 and the rear end of the developer container 64 with regard to the direction of insertion into the receptacle 66 is closed directly by the grasping member 70 or closed by a sealing member, not shown, provided between the developer container 64 and the grasping member 70.

As shown in FIG. 4, a first sealing member 72 is provided at the joint between the developer container 64 and the lid 68. The joint between the developer container 64 and the lid 68 is sealed by the first sealing member 72. In the center of the lid 68, a coupler (first coupling) 74 is rotatably supported. A second sealing member 76 is provided between the lid 68 and the coupler 74. Sealing between the lid 68 and the coupler 74 is provided by the second sealing member 76. The coupler 74 has plural first protrusions 78 protruding out of the lid 68 along the rotational axis of the coupler 74, that is, toward the direction of insertion of the developer containing device 62 into the receptacle 66, or in other words, from the front side toward the rear side of the image forming apparatus 10. The first protrusions 78 are formed circumferentially, spaced at given intervals, around the rotational axis of the coupler 74. One end of a stirring member 80 is fixed to an inward portion of the coupler 74 inside the lid 68 along the rotational axis of the coupler 74. The stirring member 80 rotates with the rotation of the coupler 74 and acts to stir the developer contained in the developer container 64, thereby pushing the developer toward a developer feed inlet 88 which will be described later. The stirring member 80 is helically formed and extends along the longitudinal direction of the cylindrical developer container 64, that is, along the direction of inserting and removing the developer containing device 62 into/from the receptacle 66.

A storage medium 82 is provided on the side wall of the lid 68 with reference to the insertion direction in which the developer containing device 62 is inserted into the receptacle 66. In the storage medium 82, information about the status of use of the developer, e.g., information of predicted developer consumption, developer color information, information about how much the developer is contained, information related to developer production, and others are stored. The storage medium 82 is provided with an exposed connector 84. Further, on the side wall of the lid 68 with reference to the insertion direction in which the developer containing device 62 is inserted into the receptacle 66, a developer container restrainer 86, as an example of a protrusion, is formed to protrude toward a direction intersecting with the insertion direction in which the developer containing device 62 is inserted into the receptacle 66, for example, in a direction perpendicular to the insertion direction. This developer container restrainer 86 limits the range within which the container will move in the direction intersecting with the insertion direction in which the developer containing device 62 is inserted into the receptacle 66, for example, in the direction perpendicular to the insertion direction. The developer container restrainer 86 also functions as a guide when the developer containing device 62 is inserted into and removed from the receptacle 66 in the image forming apparatus main body 12. The restrainer 86 slides on a guide 112 which will be described later provided in the receptacle 66. The developer container restrainer 86 protrudes, for example, in the direction perpendicular to the insertion direction in which the developer containing device 62 is inserted into the receptacle 66, and has a flat-plate structure with a given length in the insertion direction. The given length (K in FIG. 14) of the flat-plate structure in the insertion direction is set somewhat longer than the opening and closing distance (stroke) (L in FIG. 4) of an opening and closing member 102 which will be described later and approximately equal to the length of the lid 68 in the insertion direction. The forward end of the developer container restrainer 86 in the insertion direction in which the developer containing device 62 is inserted into the receptacle 66 is formed to be cut at an angle inward of the developer containing device 62 (inward of the insertion direction). The oblique forward end of the developer container restrainer 86 may be angled edges or rounded rather than straight.

With reference to the insertion direction in which the developer containing device 62 is inserted into the receptacle 66 of the main body 12 of the image forming apparatus, the developer feed inlet 88 is formed in a position near to, but somewhat backward from the forward end of the developer container 64 in the insertion direction and on the under surface (bottom side) of the container. The position of the developer feed inlet 88 on the under surface (bottom side) of the container may be angled with respect to the vertical direction, provided that it is on the under surface (bottom side) of the container below the horizontal axis. On the under surface (bottom side) of the developer container 64 and around the developer feed inlet 88, an opening and closing member support 90 is formed to protrude downward to support the opening and closing member 102 which will be described later. In this opening and closing member support 90, slide guide grooves 92 which are parallel to the insertion direction in which the developer containing device 62 is inserted into the receptacle 66 are formed on both edges of the opening and closing member support 90. At one side of the opening and closing member support 90 in the developer container 64 (at the left when viewed from the bottom as shown in FIG. 5), a flip-up part 94 is formed in the rear end of the support in the insertion direction. Further, at one side of the forward end of the opening and closing member support 90, a cutout 96, as an example of a recess, is formed. At the other side of the forward end of the opening and closing member support 90 (at the right when viewed from the bottom as shown in FIG. 5), a pawl 98 is formed. At the other side of the rear end of the opening and closing member support 90, a corner 99 is formed. Further, a third sealing member 100 is provided around the developer feed inlet 88.

The opening and closing member 102 opens and closes the developer feed inlet 88. As is shown in FIG. 6, on the inner surfaces of the opening and closing member 102, which mate with the opening and closing member support 90, plural first slide guides 104 are formed to protrude in the direction perpendicular to the insertion direction in which the developer containing device 62 is inserted into the receptacle 66 and inward of the opening and closing member 102. The first slide guides 104 move inside the above-mentioned slide guide grooves 92 of the opening and closing member support 90, so that the opening and closing member 102 will be guided slidably on the opening and closing member support 90 in the direction of inserting and removing the developer containing device 62 into/from the receptacle 66. The inner width of the opening and closing member 102 (D in FIG. 5) in the direction perpendicular to the inserting and removing direction is formed slightly wider than the width of the opening and closing member support 90 (C in FIG. 5) in the direction perpendicular to the inserting and removing direction. Thus, the opening and closing member 102 is slightly slidable on the opening and closing member support 90 also in the direction perpendicular to the inserting and removing direction. The width of the opening and closing member 102 from the edge of a protrusion 108 (F in FIG. 5) which will be described later, provided in the opening and closing member 102, in the direction perpendicular to the inserting and removing direction and the width between the pawl 98 and the cutout 96 (E in FIG. 5) of the opening and closing member support 90 in the direction perpendicular to the inserting and removing direction are set substantially equal. A slide restrainer 106 is formed at the rear end of the opening and closing member 102 in the insertion direction in which the developer containing device 62 is inserted into the receptacle 66. The slide restrainer 106 limits the movement of the opening and closing member 102 in the insertion direction by coming to a stop against the rear end of the opening and closing member support 90 in the insertion direction in which the developer containing device 62 is inserted into the receptacle 66. The opening and closing member 102 slides on, while being supported by the opening and closing member support 90, until the slide restrainer 106 comes to a stop against the rear end of the opening and closing member support 90. There is a third sealing member 100 between the opening and closing member 102 and the opening and closing member support 90 and the developer feed inlet 88 is closed by the opening and closing member 102.

On an inner surface of the opening and closing member 102, mating with the opening and closing member support 90, and at the forward end with reference to the insertion direction in which the developer containing device 62 is inserted into the receptacle 66, the protrusion 108 is formed to protrude in the direction perpendicular to the insertion direction and inward of the opening and closing member 102. On an inner surface of the opening and closing member 102, mating with the opening and closing member support 90, at the rear end with reference to the insertion direction in which the developer containing device 62 is inserted into the receptacle 66, and on the same side having the protrusion 108, a second protrusion 109 is formed to protrude in the direction perpendicular to the insertion direction and inward of the opening and closing member 102. The protrusion 108 engages with the above-mentioned cutout 96 of the opening and closing member support 90 in a state where the opening and closing member 102 closes the developer feed inlet 88. Therefore, in this sate, even if a force is applied to the opening and closing member 102 to move it in a pull-out direction from the opening and closing member support 90 (in a direction opposite to the insertion direction in which the developer containing device 62 is inserted into the receptacle 66) or reversely, even if a force is applied to the developer container 64 provided with the opening and closing member support 90 to move it in a pull-out direction from the opening and closing member 102 (in the insertion direction in which the developer containing device 62 is inserted into the receptacle 66), the engagement of the protrusion 108 with the cutout 96 prevents the opening and closing member 102 or the developer container 64 from moving in the pull-out direction and, hence, the opening and closing member 102 is kept locked with the developer container 64 so that the developer feed inlet 88 will not open.

Further, with reference to the direction of inserting and removing the developer containing device 62 into/from the receptacle 66, the length of the engagement portion of the protrusion 108 with the cutout 96 (G in FIG. 12) in the direction perpendicular to the inserting and removing direction is made shorter than the length (H in FIG. 12) within which the opening and closing member 102 is slightly slidable on the opening and closing member support 90 in the direction perpendicular to the inserting and removing direction. With reference to the direction of inserting and removing the developer containing device 62 into/from the receptacle 66, the length (I in FIG. 12) of a distance by which the protrusion 108 entering the cutout 96 moves until it abuts and engages with the cutout 96 by relative movement of the opening and closing member 102 and the opening and closing member support 90 in the inserting and removing direction is made longer than the length (J in FIG. 12) of the tip of the pawl 98 in the inserting and removing direction. Thus, when a force is applied to the opening and closing member 102 or the developer container 64 to move it in a direction intersecting with the above-mentioned pull-out direction, for example, a force is applied obliquely, the opening and closing member 102 or the developer container 64 is moved toward the above-mentioned pull-out direction. After moving more than the length of the pawl 98 tip (J in FIG. 12) in the inserting and removing direction, the opening and closing member 102 slides on the opening and closing member support 90 in the direction perpendicular to the inserting and removing direction. Then, the protrusion 108 of the opening and closing member 102 is unfastened or detached from the cutout 96 of the opening and closing member support 90 and disengaged. This disengagement allows both the opening and closing member 102 and the developer container 64 to move in the direction of inserting and removing the developer containing device 62 into/from the receptacle 66 and they are unlocked. The unlocking mechanism will be detailed later.

Next, a receptacle 66 in the image forming apparatus main body 12 is described in detail.

Figure 7:
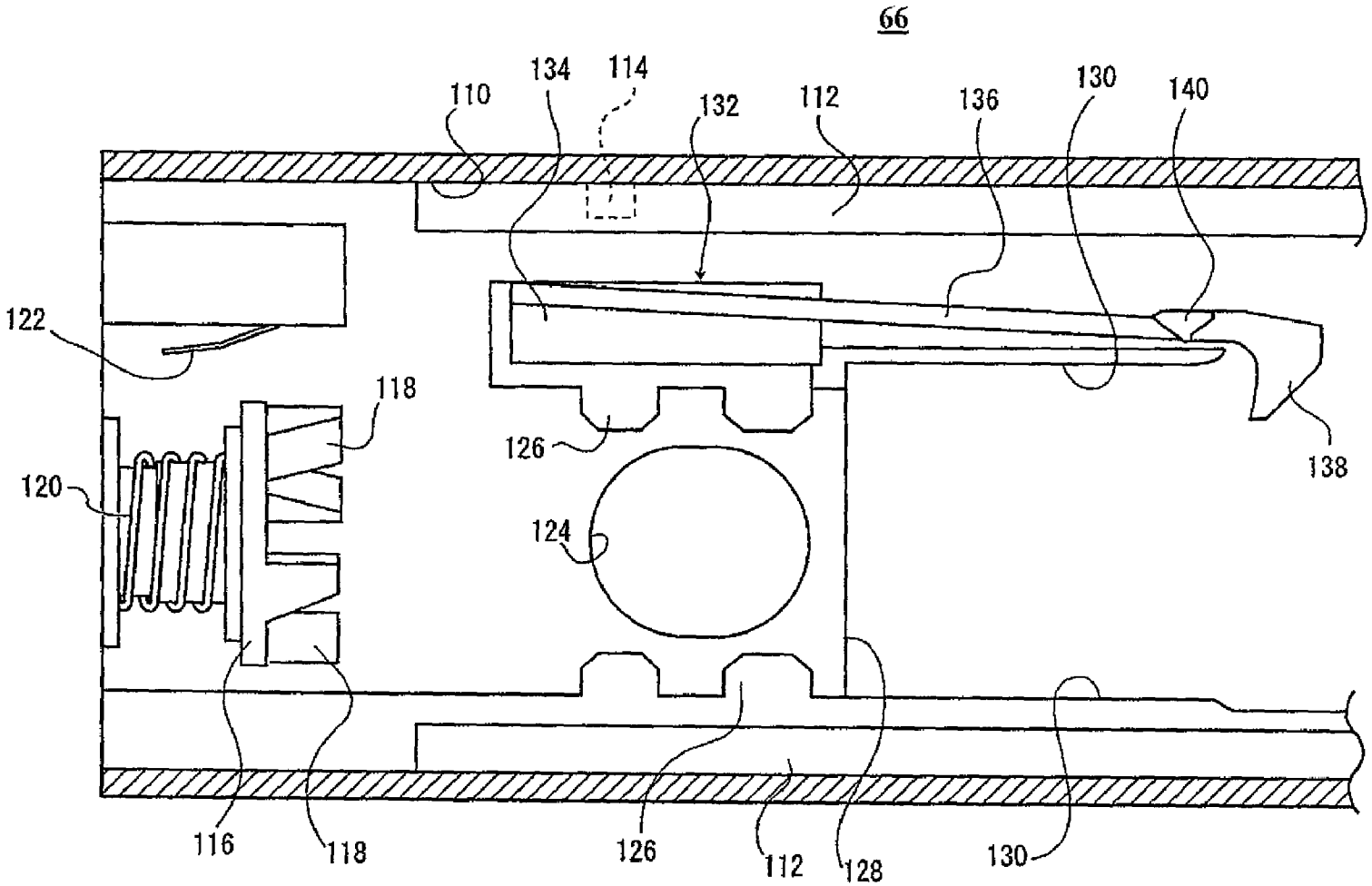
FIG. 7 is a cross sectional diagram depicting a receptacle used in the exemplary embodiment of the invention.
Figure 8:
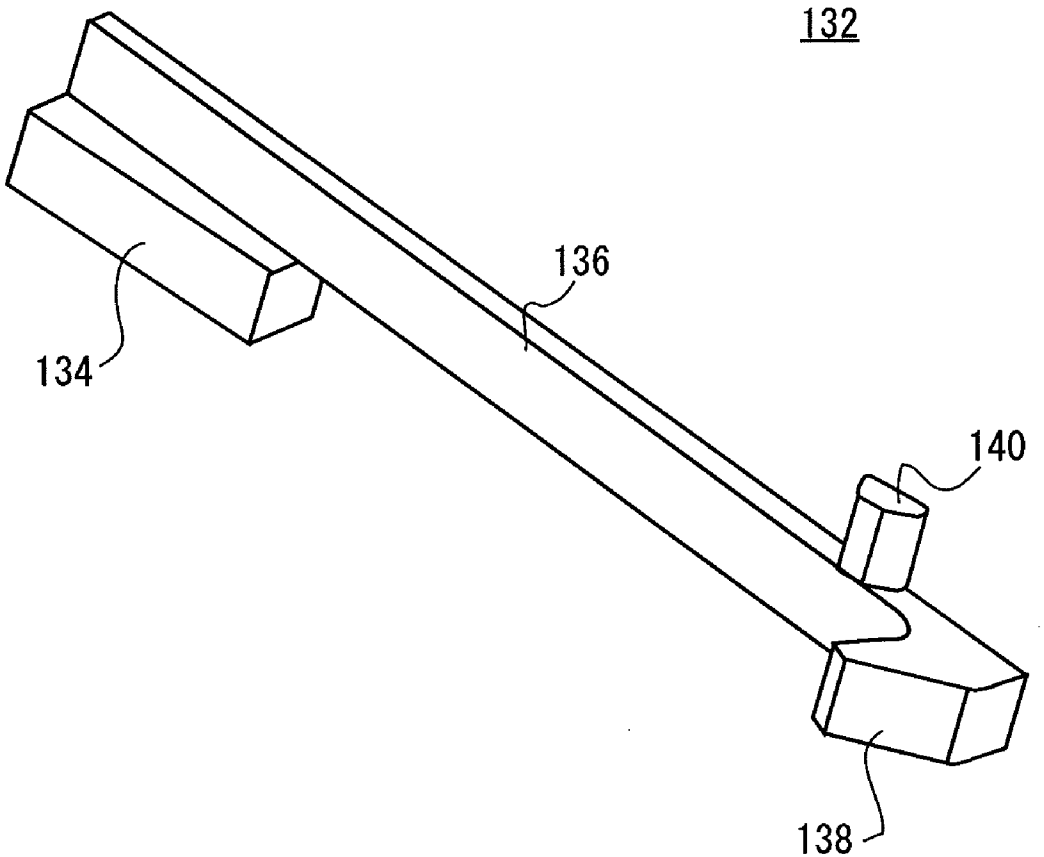
FIG. 8 is a perspective view depicting a pull-out restraining member used in the exemplary embodiment of the invention.

FIG. 7 is a cross sectional diagram of the receptacle 66 cut along a horizontal plane. FIG. 8 is a perspective view of a pull-out restraining member 132.

In the receptacle 66, a receptacle hole 110 with a diameter that is somewhat larger than the diameter of the developer containing device 62 is formed. In the receptacle hole 110, guides 112 are formed on both sides of the inner wall of the receptacle hole 110; these guides are parallel to the insertion direction of the developer containing device 62, in other words, the direction from the front to the rear of the image forming apparatus 10. The above-mentioned developer container restrainer 86 is guided on these guides 112. With reference to the insertion direction in which the developer containing device 62 is inserted into the receptacle 66, a developer container moving protrusion 114 as an example of a protrusion is formed in one guide 112 at a position somewhat backward from the forward end in the insertion direction. In the other guide 112, the developer container moving protrusion 114 is not formed. The developer container moving protrusion 114 protrudes inward (toward the center) of the receptacle hole 110, when viewed in the cross section of the receptacle hole 110 perpendicular to the insertion direction in which the developer containing device 62 is inserted into the receptacle 66. When the developer containing device 62 is inserted into the receptacle 66, an oblique edge section of the forward end of the developer container restrainer 86 being inserted on the guides 112 reaches the developer container moving protrusion 114. This protrusion 114 pushes the developer containing device 62 farther into the receptacle 66 in the insertion direction. Then, following the oblique edge of the forward end of the developer container restrainer 86, the developer containing device 62 is moved toward the other guide without the developer container moving protrusion 114, in other words, laterally in the direction perpendicular to the insertion direction in which the developer containing device 62 is inserted into the receptacle 66. The above-mentioned flat-plate parts of the developer container restrainer 86 of the developer containing device 62 touch the inner walls parallel to the insertion direction in which the developer containing device 62 is inserted into the receptacle 66. The developer containing device 62 is held placed to the side of the other guide 112, so that the range within which it will move in the direction perpendicular to the insertion direction in which the developer containing device 62 is inserted into the receptacle 66 becomes narrower.

A mated coupler (second coupling) 116 is provided in the forward end of the receptacle 66 in the insertion direction. The mated coupler 116 is provided rotatably driven by a force from a driving source not shown provided in the image forming apparatus main body 12. Plural second protrusions 118 are formed circumferentially, spaced at given intervals, around the rotational axis of the mated coupler 116. The second protrusions 118 of the mated coupler 116 engage with the first protrusions of the above-mentioned coupler 74. The coupling of the coupler 74 and the mated coupler 116 transmits a torque to the coupler 74, causing the stirring member 80 to rotate. The mated coupler 116 is supported movably in the direction of inserting and removing the developer containing device 62 into/from the receptacle 66 and urged against the insertion direction of the developer containing device 62 by a spring 120. When the developer containing device 62 is inserted, if the first protrusions 78 of the coupler 74 interfere with the second protrusions 118 of the mated coupler 116, the mated coupler 116 is retracted toward the insertion direction of the developer containing device 62. When the mated coupler 116 or the coupler 74 rotates, by the urging force of the spring 120, the first protrusions 78 of the coupler 74 engage with the second protrusions 118 of the mated coupler 116. The abutting faces of the first protrusions 78 and second protrusions 118 in the rotational direction are angled with respect to the axis of rotation, so that a force is exerted in a mutually pull-in direction when the coupler 74 and the mated coupler 116 rotate in engagement.

With reference to the insertion direction in which the developer containing device 62 is inserted into the receptacle 66, a terminal 122 that mates with the above-mentioned connector 84 of the storage medium 82 is provided at the side of the mated coupler 116 in a direction vertical to the insertion direction. The terminal 122 is made of an electrically conductive elastic member such as, for example, a leaf spring. When the developer containing device 62 has completely been inserted into the receptacle 66, the terminal 122 forces the connector 84 of the storage medium 82 into an elastically urged condition and is connected to the connector 84.

With reference to the insertion direction in which the developer containing device 62 is inserted into the receptacle 66, a developer receiving hole 124 is formed at a lower position somewhat backward from the forward end of the receptacle hole 110 in the insertion direction. The developer receiving hole 124 has a diameter that is somewhat larger than the diameter of the above-mentioned developer feed inlet 88 of the developer container 64 and is formed as an oblong hole elongating in the direction of inserting and removing the developer container 64 into/from the receptacle 66. When the developer containing device 62 has completely been inserted into the receptacle 66, the developer receiving hole 124 is connected with the developer feed inlet 88 of the developer container 64. Around the developer receiving hole 124, plural second slide guides 126 are formed to protrude toward the developer receiving hole 124 in the direction perpendicular to the insertion direction in which the developer containing device 62 is inserted into the receptacle 66. When the developer containing device 62 has completely been inserted into the receptacle 66, the slide guide grooves 92 of the opening and closing member support 90 of the developer container 64 mesh with the second slide guides 126, so that the opening and closing member support 90 is guided in the insertion direction in which the developer containing device 62 is inserted into the receptacle 66.

With reference to the insertion direction in which the developer containing device 62 is inserted into the receptacle 66, a first opening and closing member restrainer 128 is formed as, e.g., an upright wall before the developer supply hole 124 in the insertion direction (in other words, toward the front side of the image forming apparatus 10) and along the direction perpendicular to the insertion direction. The forward face of the opening and closing member 102 in the insertion direction reaches the first opening and closing member restrainer 128, thereby preventing the opening and closing member 102 from farther moving in the insertion direction in which the developer containing device 62 is inserted into the receptacle 66. The first opening and closing member restrainer 128 is not limited to the wall and, optionally, an arbitrary form thereof, such as protrusion, bar, and rib can be selected, as long as it is able to prevent the opening and closing member 102 from moving. The restrainer 128 is not necessarily perpendicular and may be angled toward a given direction or curved. Moreover, it is not necessarily a single wall, protrusion, bar, rib, or the like, and any number of those mentioned above can be selected and used. With reference to the insertion direction in which the developer containing device 62 is inserted into the receptacle 66, second opening and closing member restrainers 130 are formed as a pair of walls at both sides of the first opening and closing member restrainer 128 in the direction perpendicular to the insertion direction and extending along the insertion direction. The width between the second opening and closing member restrainers 130 in the direction perpendicular to the insertion direction is substantially equal to the width of the opening and closing member 102 in the direction perpendicular to the insertion direction. There is a positional relationship in which both sides of the opening and closing member 102 along the insertion direction are sandwiched by the second opening and closing member restrainers 130, when the developer containing device 62 is inserted into the receptacle 66. These restrainers prevent the opening and closing member 102 from moving in the direction perpendicular to the insertion direction in which the developer containing device 62 is inserted into the receptacle 66. The rear ends of the second opening and closing member restrainers 130 in the insertion direction, in other words, their forward ends when viewed from the front of the image forming apparatus 10 are tapered so that their width becomes gradually wider in the direction perpendicular to the insertion direction. This makes it easy to receive the opening and closing member 102 between the second opening and closing member restrainers 130. The second opening and closing member restrainers 130 are also not limited to walls and, optionally, an arbitrary form thereof, such as protrusions, bars, and ribs can be selected, as long as they are able to prevent the opening and closing member 102 from moving. The restrainers 130 are not necessarily perpendicular and may be angled toward a given direction or curved. Moreover, each of these restrainers 130 is not necessarily a single wall, protrusion, bar, rib, or the like, and any number of those mentioned above can be selected and used.

As is depicted in FIG. 8, the pull-out restraining member 132 includes a base 134, a bending allowable part 136 extending from the base 134 toward a pull-out direction in which the developer containing device 62 is pulled out from the receptacle 66, a third opening and closing member restrainer 138 formed at the tip of the bending allowable part 136, and a flipped-up part 140 formed on the top face of the bending allowable part 136 in a position somewhat backward from the third opening and closing member restrainer 138 in the pull-out direction (in other words, toward the rear side of the image forming apparatus 10). The pull-out restraining member 132 is provided along a second opening and closing member restrainer 130 positioned in one side and the base 134 is fixed to the receptacle 66. The bending allowable part 136, the third opening and closing member restrainer 138, and the flipped-up part 140 are movable in unison with elastic deformation of the bending allowable part 136. When the bending allowable part 136 is in a free form, the pull-out restraining member 132 is placed such that the third opening and closing member restrainer 138 is positioned forward of the second opening and closing member restrainer 130 positioned in one side in the pull-out direction (in other words, toward the front side of the image forming apparatus 10) and the restraining member 132 is placed over the above second opening and closing member restrainer 130 positioned in one side when viewed from the front of the image forming apparatus 10. The third opening and closing member restrainer 138 has a sloping surface with which the opening and closing member 102 is brought in contact at its rear end in the insertion direction with reference to the insertion direction in which the developer containing device 62 is inserted into the receptacle 66 (in other words, toward the front side of the image forming apparatus 10). Farther in the insertion direction (toward the rear side of the image forming apparatus 10), the sloping surface is oriented to gradually approach the above second opening and closing member restrainer 130 positioned in the other side. The sloping surface is oriented in the same direction as the tapered end face of the second opening and closing member restrainer 130 positioned in one side in the tapered end faces of the above-mentioned second opening and closing member restrainers 130. With reference to the insertion direction in which the developer containing device 62 is inserted into the receptacle 66, the bending allowable part 136 deforms elastically, when the sloping surface of the third opening and closing member restrainer 138 is pressed toward the insertion direction with the forward end of the opening and closing member 102 in the insertion direction, or when the flipped-up part 140 is pressed by the flip-up part 94 of the developer container 64, as will be described later. With the elastic deformation of the bending allowable part 136, when the third opening and closing member restrainer 138 is retracted from its position when it is in the free form, where it is placed over the second opening and closing member restrainer 130 positioned in one side when viewed from the front side of the image forming apparatus 10, the developer container 64 and the opening and closing member 102 are allowed to move. However, if the developer containing device 62 is pulled out from the receptacle 66, with reference to the insertion direction in which the developer containing device 62 is inserted into the receptacle 66, as the developer containing device 62 is moved against the insertion direction, the rear end of the opening and closing member 102 in the insertion direction (forward end in opposition to the insertion direction) comes to a stop against the forward surface of the third opening and closing member restrainer 138 in the insertion direction. This restrains the opening and closing member 102 from moving against the insertion direction. As the developer container 64 is moved against the insertion direction, the developer feed inlet 88 is closed by the opening and closing member 102. The bending allowable part 136 does not deform elastically and the third opening and closing member restrainer 138 restrains the opening and closing member 102 from moving, until the protrusion 108 of the opening and closing member 102 fits in the cutout 96 of the opening and closing member support 90 and the opening and closing member 102 and the developer container 64 are brought in a positional relationship where they can be engaged again. When the flipped-up part 140 is flipped up by the flip-up part 94 of the developer container 64, the bending allowable part 136 deforms elastically and the third opening and closing member restrainer 138 allows the opening and closing member 102 to move.

Next, examples of operations of inserting the developer containing device 62 into the receptacle 66 and removing it from the receptacle 66 are detailed.

Figure 9:
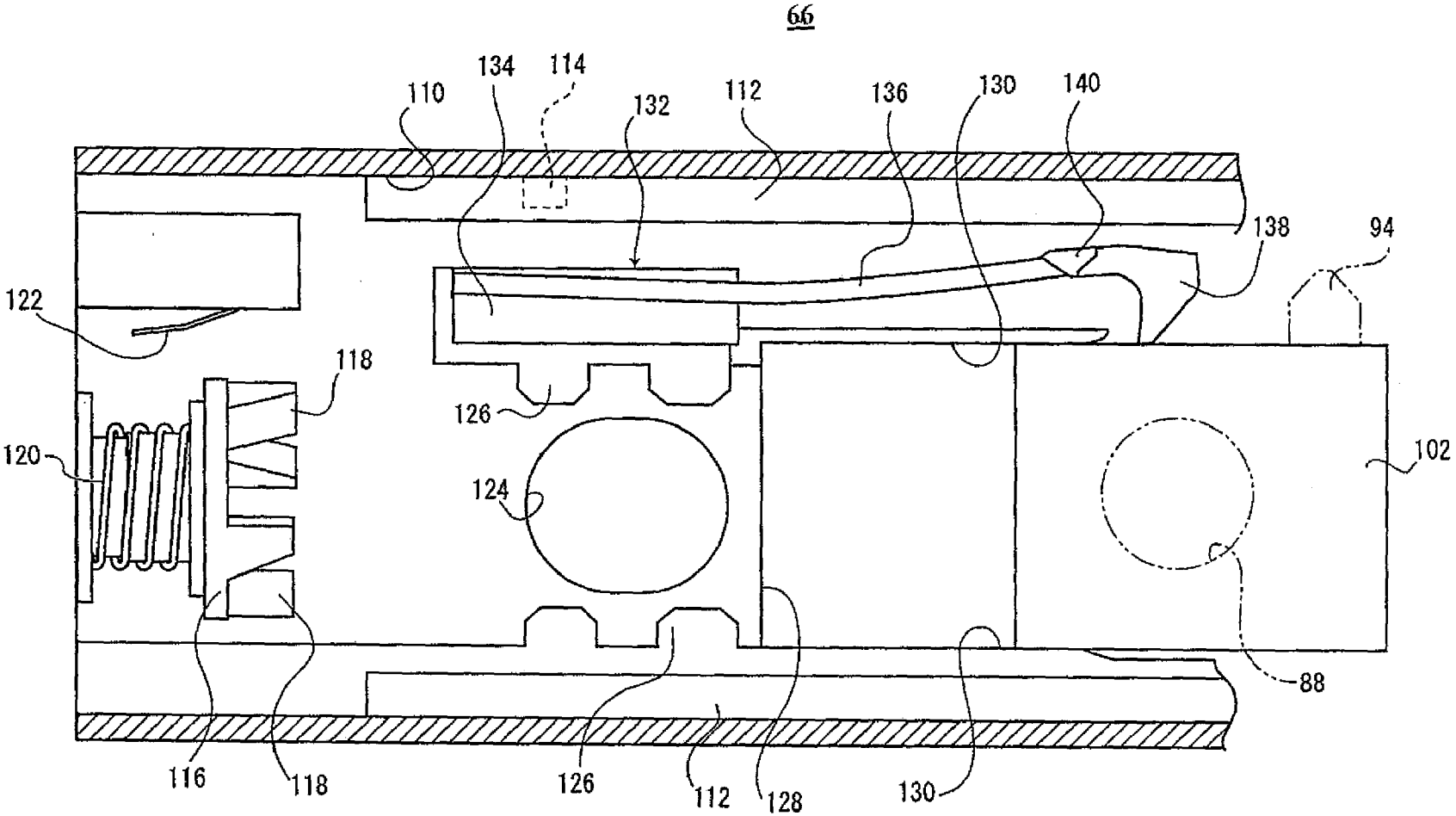
FIG. 9 is a cross sectional view of the receptacle, depicting a state in which, after the start of inserting the developer containing device into the receptacle, the opening and closing member begins to slide between second opening and closing member restrainers, in the exemplary embodiment of the invention.
Figure 10:
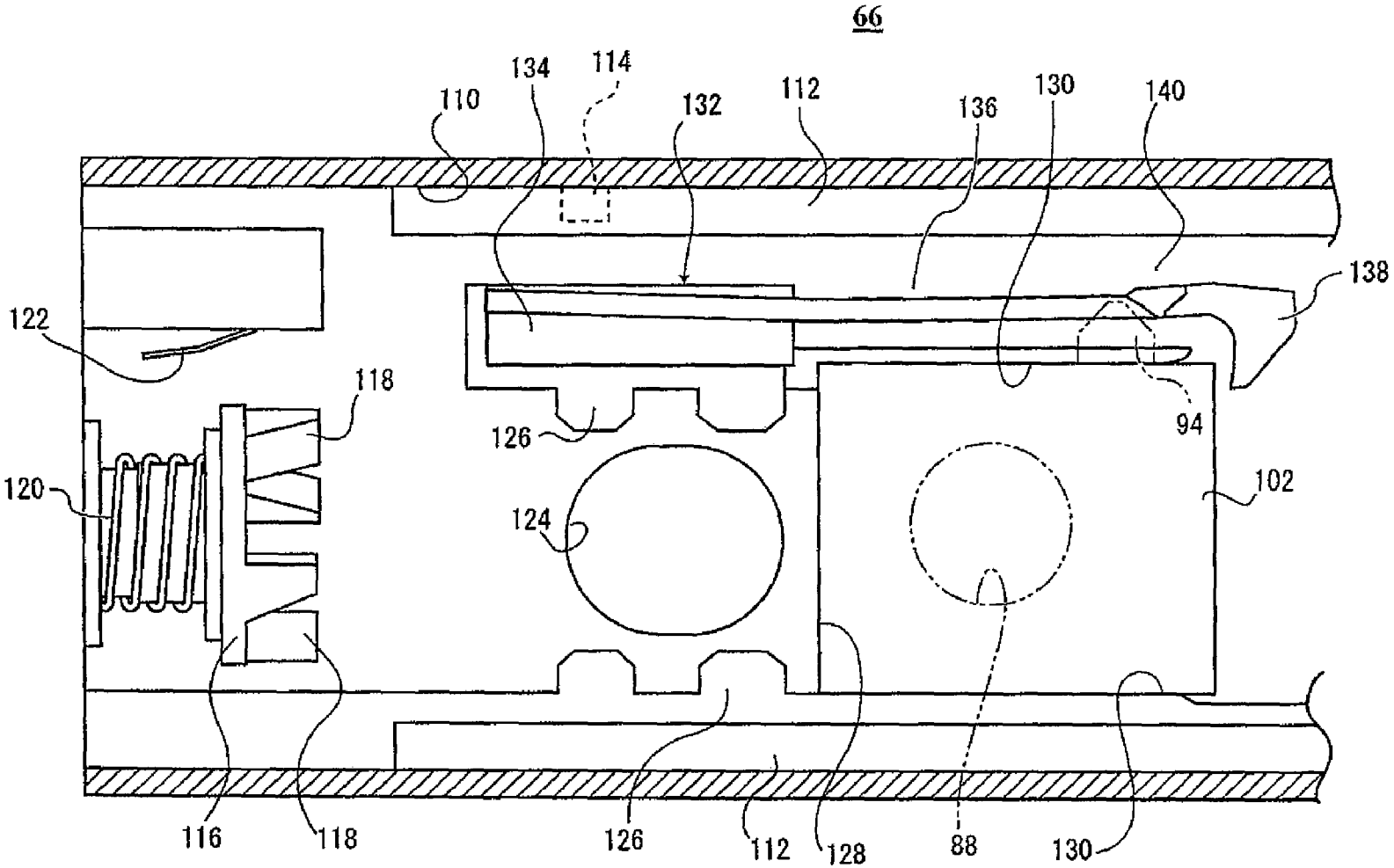
FIG. 10 is a cross sectional view of the receptacle, depicting a state in which the opening and closing member has reached a first opening and closing member restrainer, in the exemplary embodiment of the invention.
Figure 11:
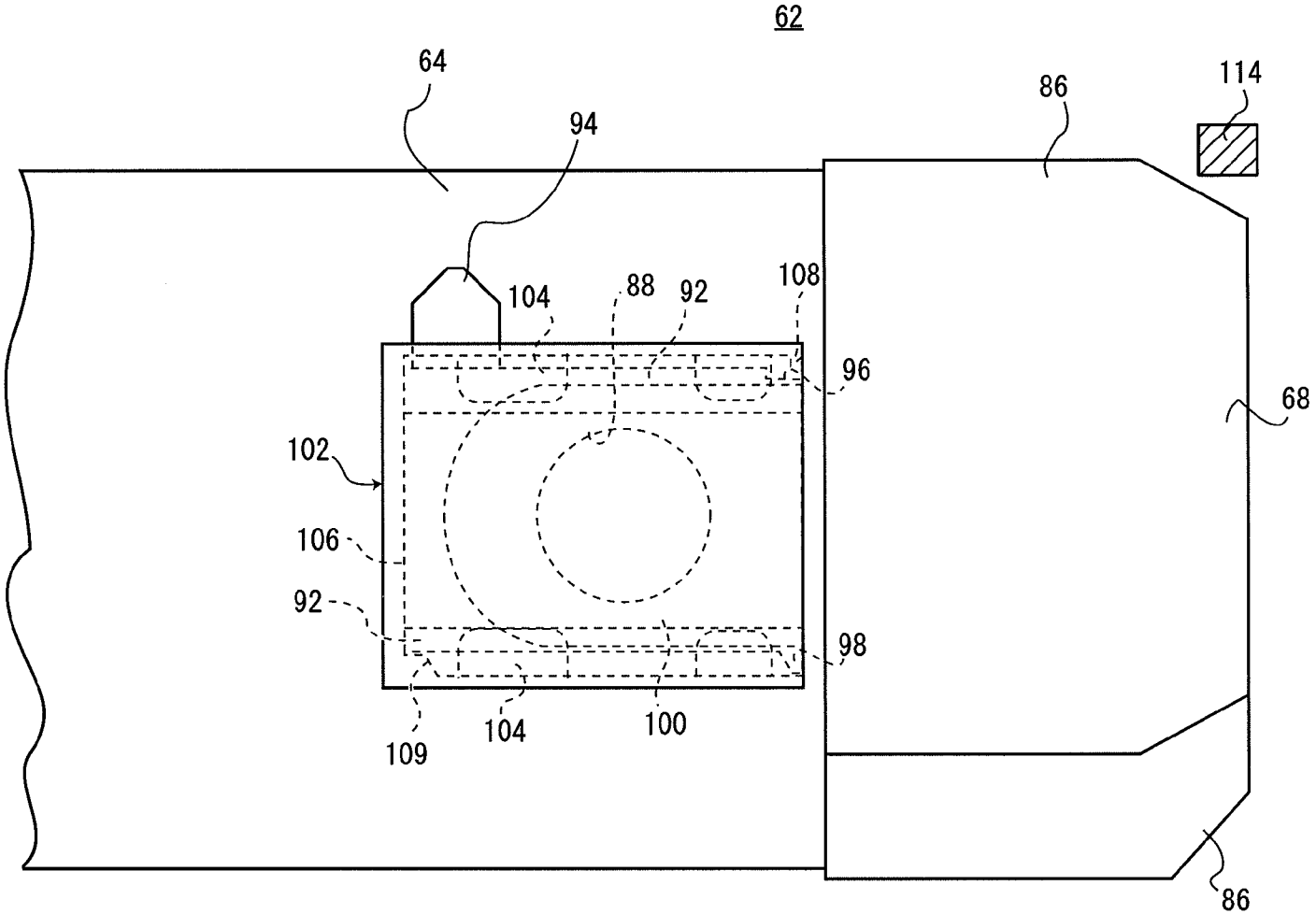
FIG. 11 is a bottom plan view of the developer containing device, depicting the state in which the opening and closing member has reached the first opening and closing member restrainer, in the exemplary embodiment of the invention.
Figure 12A:
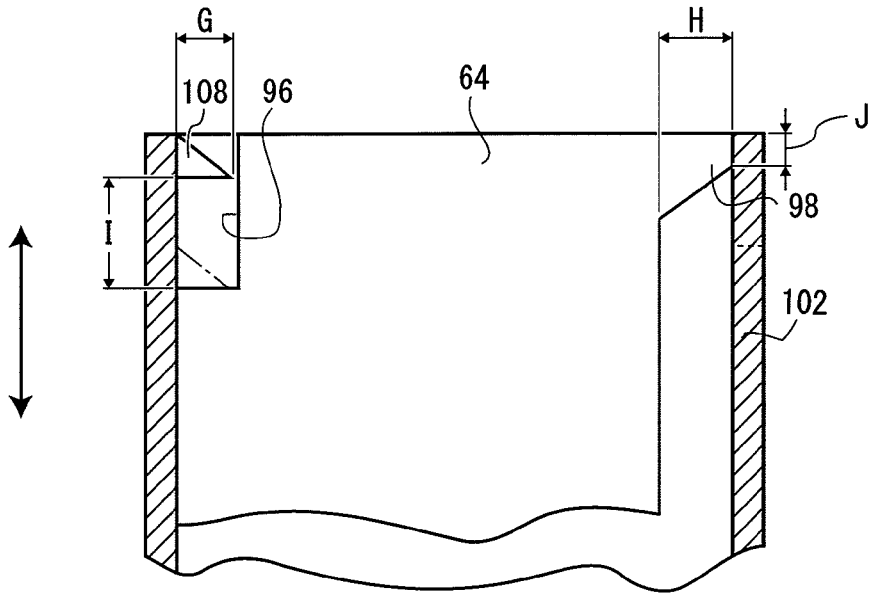
FIG. 12A is a cross sectional diagram depicting a state of locking of the developer container to the opening and closing member in the exemplary embodiment of the invention.
Figure 12B:
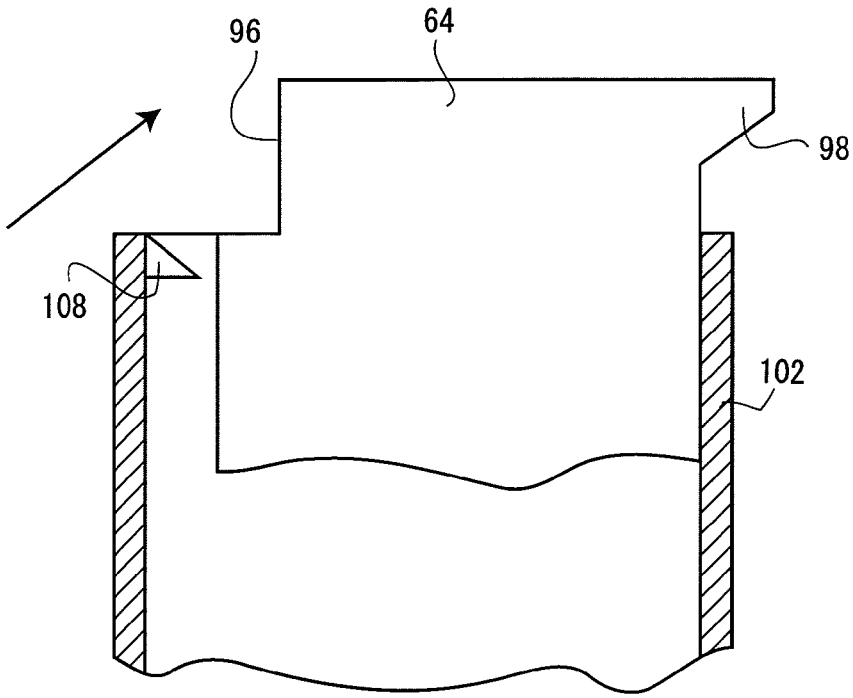
FIG. 12B is a cross sectional diagram depicting a state of unlocking of the developer container from the opening and closing member in the exemplary embodiment of the invention.
Figure 13:
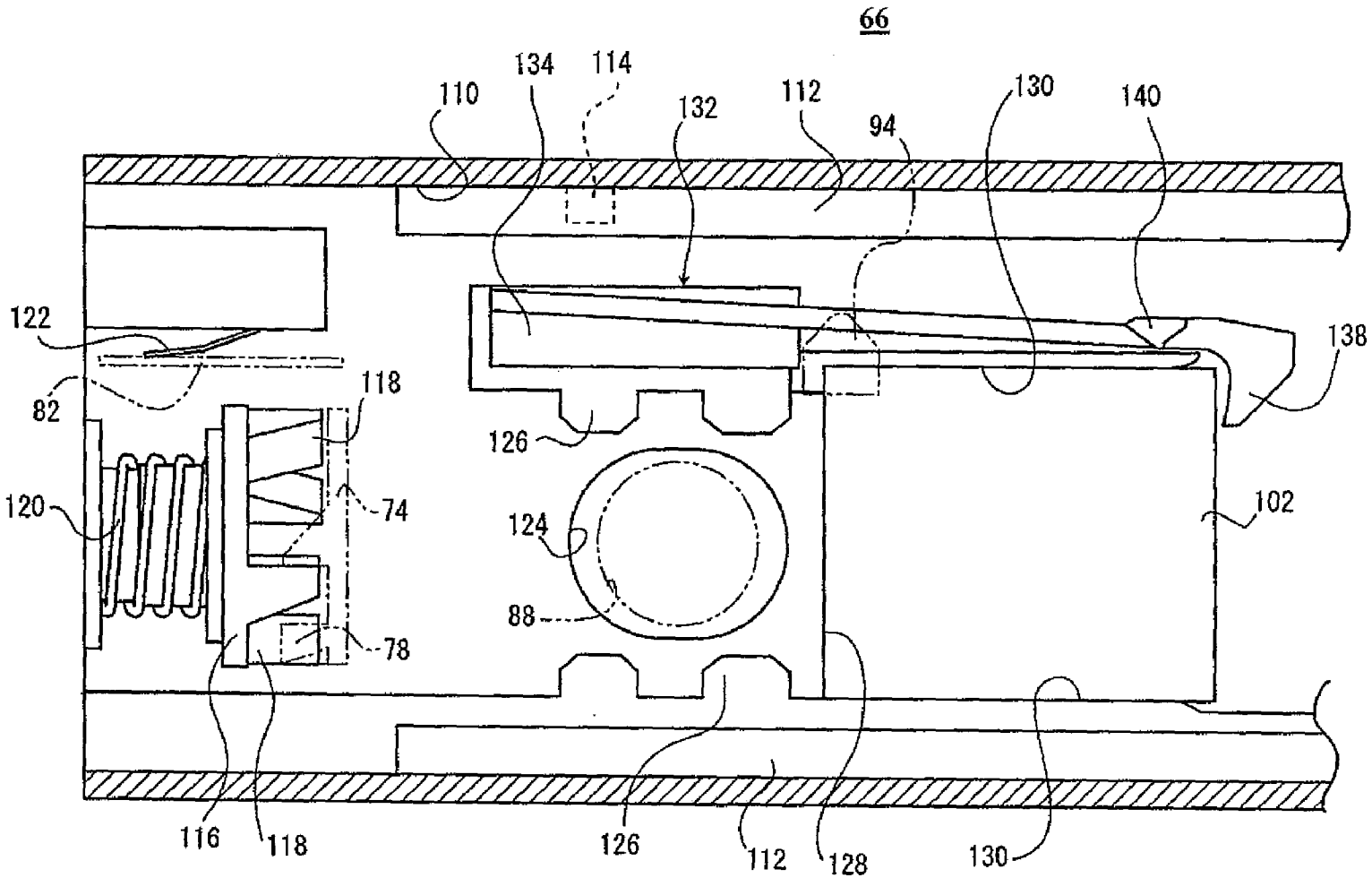
FIG. 13 is a cross sectional view of the receptacle, depicting a state in which the developer container has been inserted completely in the exemplary embodiment of the invention.
Figure 14:
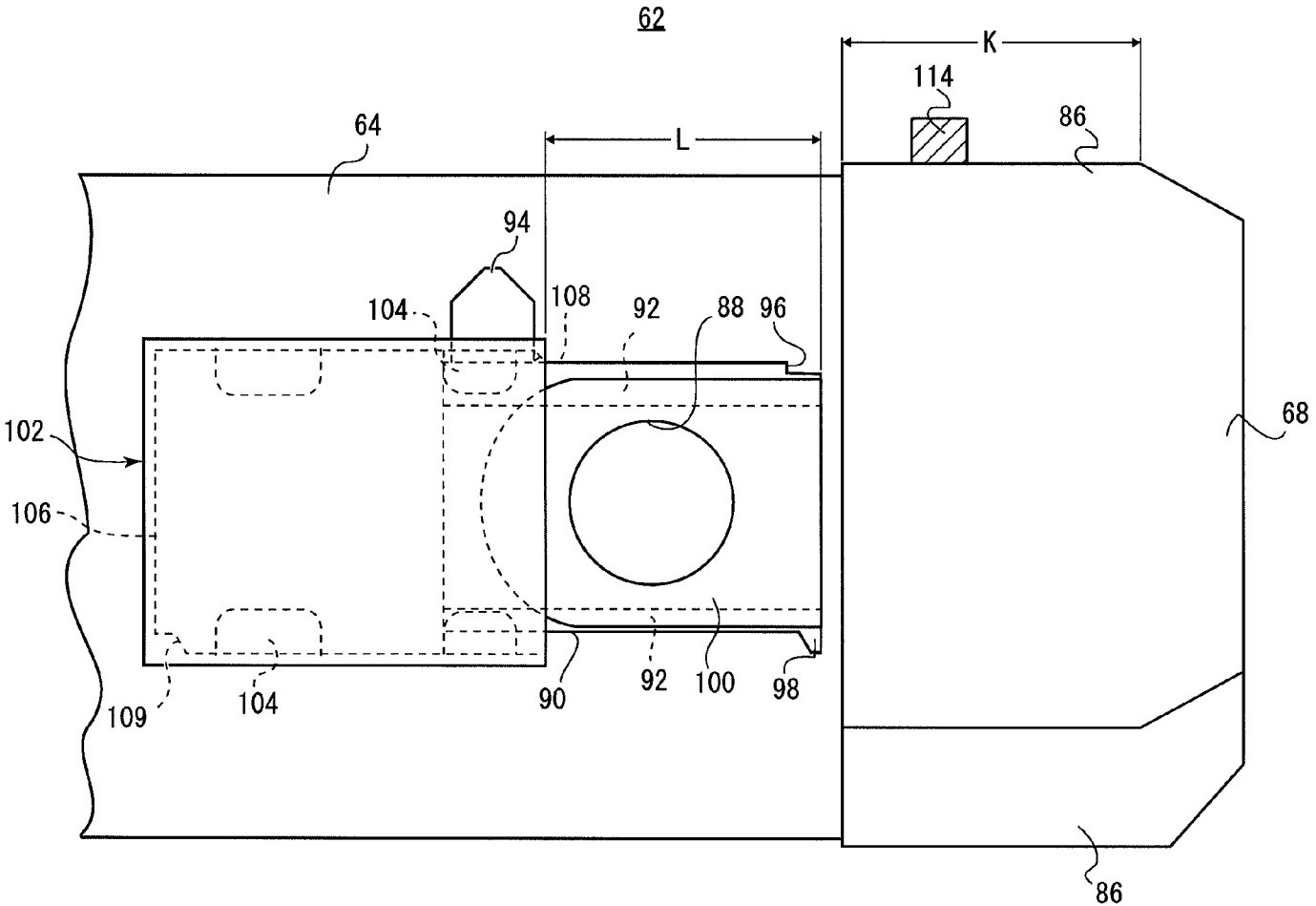
FIG. 14 is a bottom plan view of the developer container, depicting the state in which the developer container has been inserted completely in the exemplary embodiment of the invention.
Figure 15A:
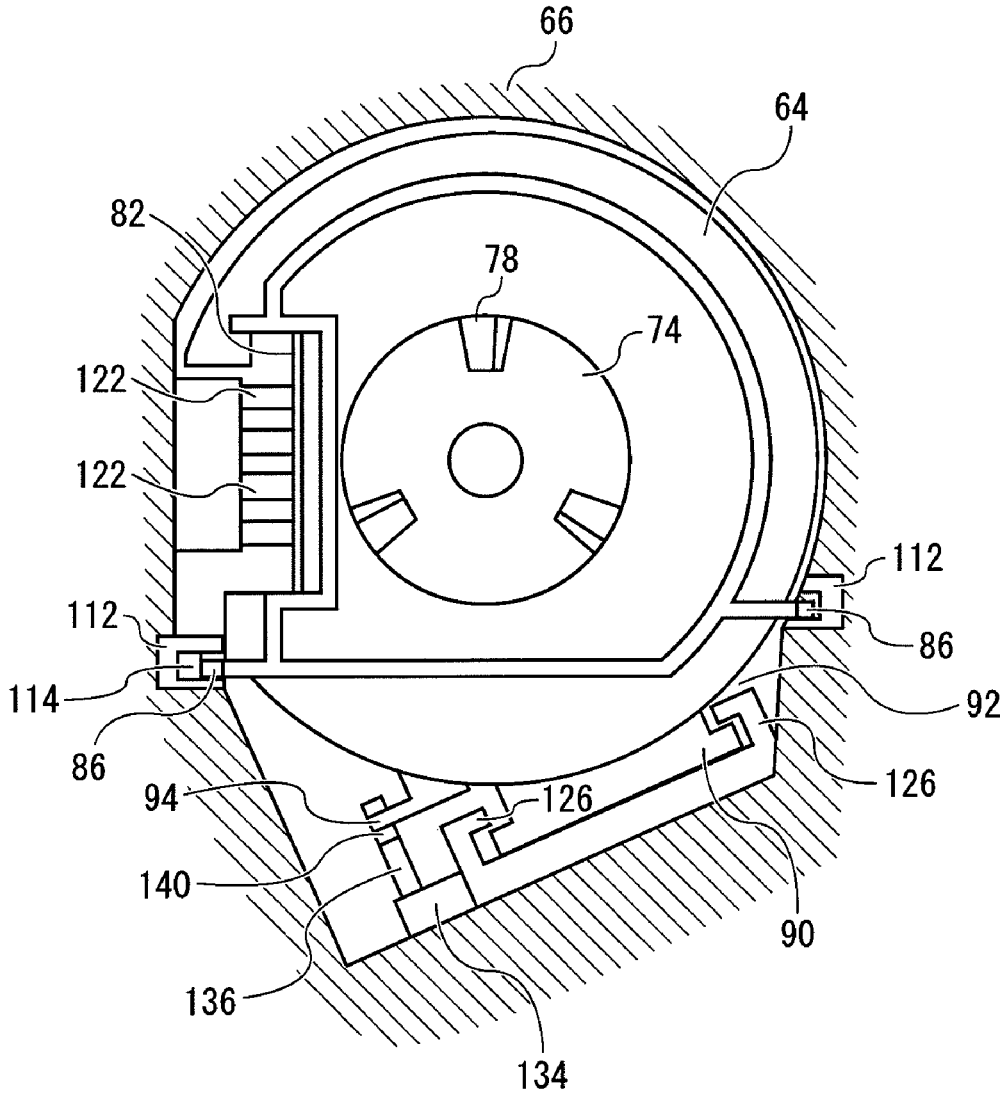
FIGS. 15A and 15B are cross sectional views of the developer containing and the receptacle, depicting the state in which the developer container has been inserted completely in the exemplary embodiment of the invention.
Figure 15B:
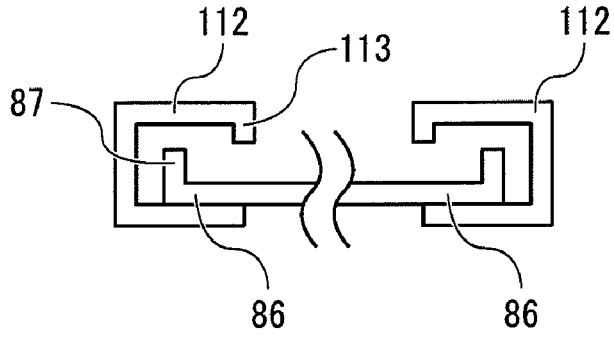
Figure 16:
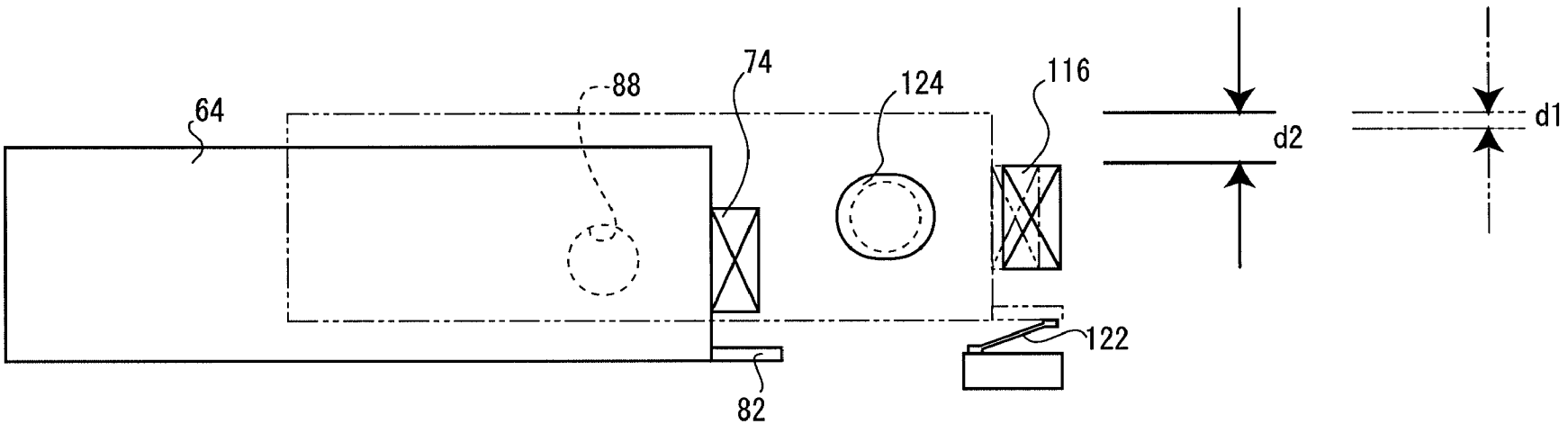
FIG. 16 schematically illustrates a positional relationship between the developer containing device and the receptacle in the exemplary embodiment of the invention.
Figure 17:
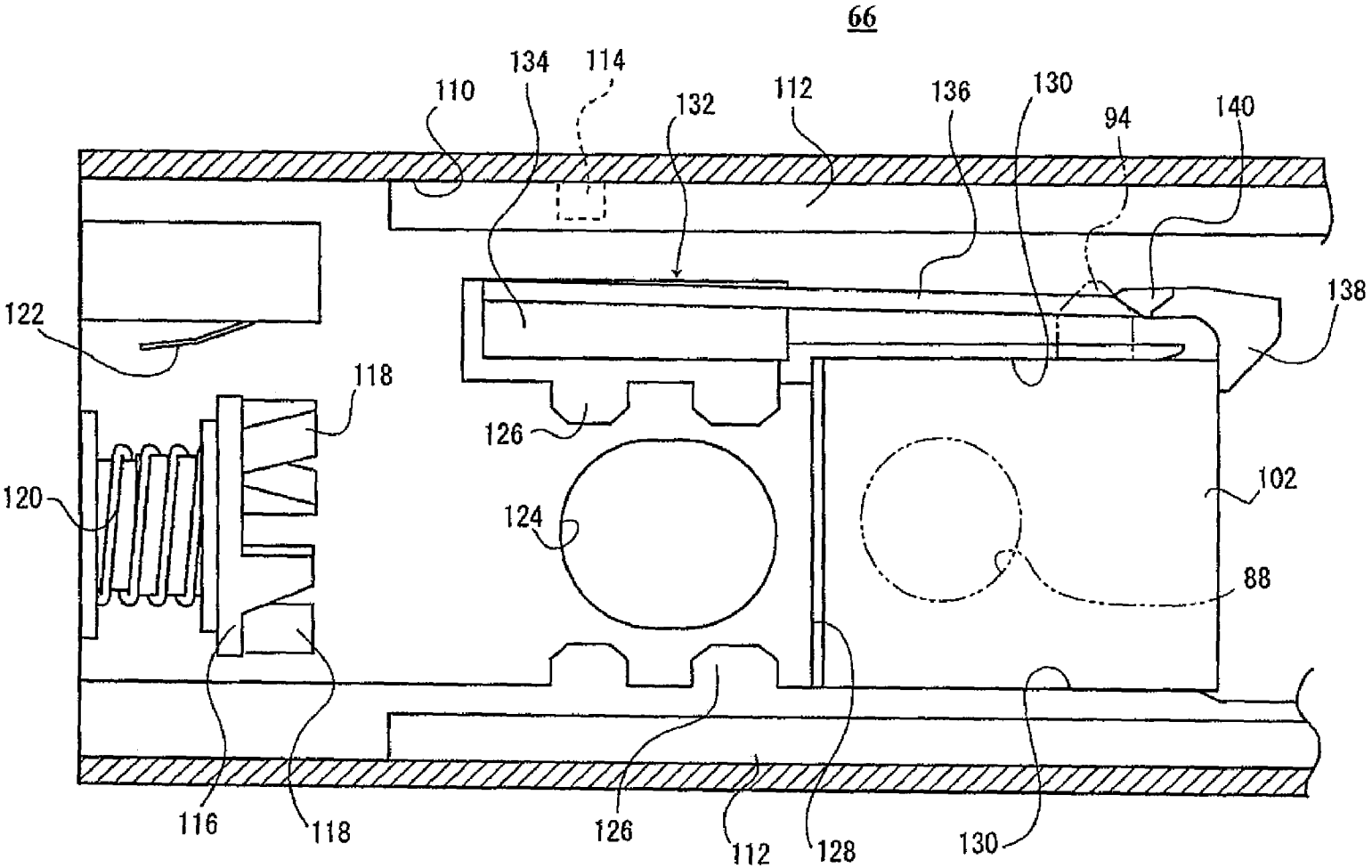
FIG. 17 is a cross sectional view of the receptacle depicting a state in the middle of pulling out the developer container from the receptacle in the exemplary embodiment of the invention.

FIG. 9 is a cross sectional view of the receptacle 66, depicting a state in which, after the start of inserting the developer containing device 62 into the receptacle 66, the opening and closing member 102 begins to slide between the second opening and closing member restrainers 130. FIG. 10 is a cross sectional view of the receptacle 66, depicting a state in which the opening and closing member 102 has reached the first opening and closing member restrainer 128. FIG. 11 is a bottom plan view of the developer containing device 62, depicting the same state as in FIG. 10. FIGS. 12A and 12B are cross sectional views depicting states of locking and unlocking of the developer container 64 to/from the opening and closing member 102. FIG. 13 is a cross sectional view of the receptacle 66, depicting a state in which the developer container 64 has been inserted completely. FIG. 14 is a bottom plan view of the developer containing device 62, depicting the same state as in FIG. 13. FIGS. 15A and 15B are cross sectional views of the developer containing device 62 and receptacle 66 in the same state as in FIG. 13. FIG. 16 schematically illustrates a positional relationship between the developer containing device 62 and the receptacle 66. FIG. 17 is a cross sectional view of the receptacle 66, depicting a state in the middle of pulling out the developer container 64 from the receptacle 66.

To install the developer containing device 62 in the receptacle 66, first, hold the grasping member 70 of the developer containing device 62 by hand, insert the developer containing device 62 with the lid 68 foremost into the receptacle hole 110 defined in the image forming apparatus main body 12, and begin to insert it farther into the receptacle hole 110. In this state, the developer containing device 62 is guided from the front side to the rear side of the image forming apparatus 10, while the developer container restrainer 86 slides on the guides 112. The motion of the opening and closing member 102 with respect to the developer container 64 is restrained and locked, as the protrusion 108 of the opening and closing member 102 fits in or engages with the cutout 96 of the opening and closing member support 92. The developer feed inlet 88 is closed by the opening and closing member 102. With reference to the direction in which the developer containing device 62 is inserted into the receptacle 66, none of the forward end, rear end, both sides, and under side (bottom of the developer containing device 62) of the opening and closing member 102 contacts the receptacle 66 and the opening and closing member 102 is moved farther into the receptacle 66. When the developer containing device 62 is farther inserted into the receptacle hole 110, as depicted in FIG. 9, one side corner of the forward end of the opening and closing member 102 touches the sloping surface formed in the third opening and closing member restrainer 138 of the pull-out restraining member 132 and pushes aside the third opening and closing member restrainer 138. The opening and closing member 102 is guided between the second opening and closing member restrainers 130.

When the developer containing device 62 is farther inserted, as depicted in FIG. 10, the leading edge face of the opening and closing member 102, which is the forward end in the insertion direction of the developer containing device 62, reaches the upright wall of the first opening and closing member restrainer 128 along the direction perpendicular to the insertion direction, thereby preventing the opening and closing member 102 from moving forward in the insertion direction of the developer containing device 62. When the developer containing device 62 is farther inserted, the leading edge face of the opening and closing member 102 is pressed against the first opening and closing member restrainer 128. The developer container 64 moves in the insertion direction relative to the opening and closing member 102, while the motion of the opening and closing member 102 is prevented by the first opening and closing member restrainer 128. When the developer container 64 moves in the insertion direction, as depicted in FIG. 11, in the forward end of the developer container 64 in the insertion direction, the oblique edge section of the forward end of the developer container restrainer 86 formed to protrude in the direction intersecting the insertion direction reaches the developer container moving protrusion 114 provided in one side guide 112 of the guides 112 formed on both inner sides of the receptacle hole 110. Thereby, the developer container 64 moves in its insertion direction and moves also in the direction perpendicular to the insertion direction. At this time, as the developer container 64 is moved in the direction perpendicular to the insertion direction, the opening and closing member 102 being pressed against the first opening and closing member restrainer 128 is subjected to a force exerted in the same direction perpendicular to the insertion direction. In consequence, the other side of the opening and closing member 102, opposite to the side in which the developer container moving protrusion 114 is provided, is also pressed against one of the second opening and closing member restrainers 130, that is, the second opening and closing member restrainer 130 in the other side opposite to the side in which the developer container moving protrusion 114 is provided.

In the state where the protrusion 108 of the opening and closing member 102 fits in the cutout 96 of the developer container 64, as depicted in FIG. 12A, the developer container 64 is engaged with the opening and closing member 102 and their locking is kept, even if it is tried to move the developer container 64 and the opening and closing member 102 in the insertion direction of the developer containing device 62. However, as depicted in FIG. 12B, when the opening and closing member 102 is subjected to an oblique force with respect to the insertion direction of the developer container 64, the opening and closing member 102 moves along the pawl 98 of the developer container 64. Then, the engaged protrusion 108 of the opening and closing member 102 is detached from the cutout 96 of the developer container 64 and the developer container 64 and the opening and closing member 102 are unlocked (disengaged).

When the developer container 64 is farther inserted into the receptacle 66, as depicted in FIGS. 14, 15A and 15B, the developer container 64 is moved farther into the receptacle 66 with the developer container restrainer 86 contacting the developer container moving protrusion 114, while the opening and closing member 102 remains blocked by the first opening and closing member restrainer 128. Therefore, the developer container 64 is moved farther into receptacle 66 with the other side of the opening and closing member 102, opposite to the side in which the developer container moving protrusion 114 is provided, being pressed against the second opening and closing member restrainer 130 in the other side opposite to the side in which the developer container moving protrusion 114 is provided. As the developer container 64 moves as above, the range within which it will move in the direction perpendicular to its insertion direction becomes narrower. Then, the slide guide grooves 92 of the opening and closing member support 90 provided in the developer container 64 gradually transfer from the first slide guides 104 formed in the opening and closing member 102 to the second slide guides 126 formed around the developer receiving hole 124 so as to be guided on the second slide guides. Eventually, the developer container 64 is completely inserted into the receptacle 66 with the opening and closing member 102 being pressed against the first opening and closing member restrainer 128 and the second opening and closing member restrainers 130. At this time, the developer feed inlet 88 of the developer container 64 is connected with the developer receiving hole 124 of the receptacle 66, the first protrusions 78 of the coupler 74 engage with the second protrusions 118 of the mated coupler 116, and the connector 84 of the storage medium 82 is connected to the terminal 122 and held with the urging force of the terminal 122.

Now, FIG. 16 illustrates comparison between the state before the developer container 64 is completely inserted into the receptacle 66 (as depicted by solid lines) and the state when the developer container 64 has completely been inserted into the receptacle 66 (as depicted by chain double-dashed lines). By this comparison, the range d1 within which the developer container 64 will move in the direction perpendicular to its insertion direction, when inserted completely, is narrower than the range d2 within which the developer container 64 will move in the direction perpendicular to its insertion direction before it is inserted completely, as the developer container restrainer 86 of the lid 68 of the developer containing device 62 is hampered by the developer container moving protrusion 114. In this way, the range d2 within which the developer container 64 will move is restricted. The developer feed inlet 88 is aligned with the developer receiving hole 124 within a tolerance, the axial alignment between the coupler 74 and the mated coupler 116 is achieved within a tolerance, and the terminal 122 is fastened onto the storage medium 82 with a certain urging force.

To remove the developer containing device 62 from the receptacle 66, hold the grasping member 70 of the developer containing device 62 by hand and begin to pull out the developer containing device 62. The developer container 64 is moved in the pull-out direction with the opening and closing member 102 being pressed against the second opening and closing member restrainers 130. The slide guide grooves 92 in the opening and closing member support 90 provided in the developer container 64 gradually transfer from the fit-in state in the second slide guides 126 formed around the developer receiving hole 124 to the first slide guides 104 formed in the opening and closing member 102 so as to be guided on the first slide guides 104. The coupler 74 is disengaged from the mated coupler 116, the storage medium 82 is disconnected from the terminal 122, and the developer feed inlet 88 is disconnected from the developer receiving hole 124. At this time, as depicted in FIG. 17, the opening and closing member 102 also moves in the pull-out direction and the state where it is pressed against the first opening and closing member restrainer 128 changes to the state where the rear end of the opening and closing member 102 in the insertion direction contacts and is pressed against the third opening and closing member restrainer 138 of the pull-out restraining member 132. Therefore, the slide guide grooves 92 in the opening and closing member support 90 of the developer container 64 again mesh with the first slide guides 104 of the opening and closing member 102 and the developer feed inlet 88 is closed by the opening and closing member 102. Before the slide guide grooves 92 in the opening and closing member support 90 of the developer container 64 completely mesh with the first slide guides 104 of the opening and closing member 102, the developer container restrainer 86 formed in the developer container 64 is released from the developer container moving protrusion 114 provided in the guide 112 and the opening and closing member 102 is released from the force of pressing it against the second opening and closing member restrainers 130.

When the developer containing device 62 is farther pulled out from the receptacle hole 110, the pawl 98 formed in the opening and closing member support 90 comes into contact with the forward end of the opening and closing member 102 in the insertion direction of the developer containing device 62. At the same time, the rear end of the opening and closing member support 90 in the insertion direction of the developer containing device 62 comes into contact with the second protrusion 109 formed in the opening and closing member 102 (because A and B in FIG. 5 are set substantially equal), and the developer container 64 is farther removed, while contacting with the pawl 98 and the slope of the second protrusion 109. This causes the motion in the direction intersecting with the pull-out direction of the developer container 64, that is, toward the pawl 98 and the slope of the second protrusion 109. The opening and closing member 102 is subjected to a force exerted in the direction intersecting with the pull-out direction of the developer container 64, that is, toward the opposite side to the side in which the pawl 98 and the second protrusion 109 are provided. In consequence, the opening and closing member 102 is pressed against the third opening and closing member restrainer 138, and the other side of the opening and closing member 102, opposite to the side where the pawl 98 and the second protrusion 109 are provided, is also pressed against the other second opening and closing member restrainer 130, that is, the second opening and closing member restrainer 130 in the opposite side to the side where the pawl 98 and the second protrusion 109 are provided.

When a further force is applied to the developer containing device 62 in the direction of pulling out it from the receptacle hole 110, because the opening and closing member 102 is hampered, pressed against the second opening and closing member restrainer 130 in the other side opposite to the side where the pawl 98 and the second protrusion 109 are provided, the developer container 64 moves relative to the opening and closing member 102 in the direction intersecting with the pull-out direction. The protrusion 108 of the opening and closing member 102 fits in the cutout 96 of the developer container 64 and the opening and closing member 102 is locked to the developer container 64 again. When the developer container 64 is farther pulled out, the flip-up part 94 of the developer container 64 touches the flipped-up part 140 of pull-out restraining member 132 and the opening and closing member 102 is released from the blockage by the third opening and closing member restrainer 138 in the pull-out direction, while the opening and closing member 102 is prevented from skewing by the second opening and closing member restrainers 130, because the width of the opening and closing member 102 in the direction intersecting with the pull-out direction and the width between the second opening and closing member restrainers 130 are substantially equal. As the developer containing device 62 is farther pulled out from the receptacle hole 110, the opening and closing member 102 is moved through the receptacle 66 toward the front side of the image forming apparatus main body 12, wherein, with reference to the direction in which the developer containing device 62 is inserted into the receptacle 66, none of the forward end, rear end, both sides, and under side (bottom of the developer containing device 62) of the opening and closing member 102 contacts the receptacle 66, and the developer containing device 62 is pulled out from the receptacle hole 110.

As depicted in FIG. 15B, to make the shapes of the guides 112 and the developer container restrainer 86 hard to disengage from each other, retaining parts 113 may be formed in the guides 112, which extend out downward from the end of the upper structure of each guide 112 in the insertion direction of the developer containing device 62. Likewise, engaging parts 87 may be formed in the developer container restrainer 86, which protrude upward from the edges of the developer container restrainer 86 in the direction intersecting the insertion direction of the developer containing device 62.

In the exemplary embodiment described hereinbefore, the developer containing device 62 is inserted into the receptacle 66 directly defined in the main body 12 of the image forming apparatus 10. However, the present invention is not so limited. The invention is also applied in a case where the developer containing device 62 is inserted into a receptacle defined in a so-called process cartridge that is a unit including a photoreceptor and a development device, wherein the unit is removably installed in the image forming apparatus. Hence, the term "image forming apparatus main body" used in the appended claims means not only an image forming apparatus main body but also a process cartridge main body which is installed in the image forming apparatus main body.

The present invention may be embodied in other specific forms without departing from its spirit or characteristics. The described exemplary embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. A developer containing device comprising:

a developer container configured to contain developer and to be inserted into a receptacle defined in an image forming apparatus main body;

a developer feed inlet provided in the developer container and for feeding the developer contained in the developer container into the image forming apparatus main body; and an opening and closing member that opens the developer feed inlet with movement of the developer container in the insertion direction when the developer container is inserted into the receptacle and closes the developer feed inlet with movement of the developer container in opposition to the insertion direction when the developer container is removed from the receptacle, the opening and closing member having a protrusion formed to protrude inward of the opening and closing member and allowed to engage with a recess provided in the developer container, and having a second protrusion in the rear end of the opening and closing member with regard to the insertion direction, formed to protrude inward of the opening and closing member, and being arranged to be allowed to move on the outside of the developer container in a direction intersecting with the insertion direction of the developer container, when the developer container is inserted into the receptacle, a developer container outside section sliding into the opening and closing member being relatively brought to one side of the opening and closing member in the direction intersecting with the insertion direction of the developer container, then the protrusion being released from the an engageable state, when the opening and closing member moves to close the developer feed inlet, the rear end of the opening and closing member with regard to the insertion direction is pressed against the restrainers provided in the receptacle at least, and when the developer container is moved in opposition to the insertion direction with the developer feed inlet being opened by the opening and closing member, the protrusion moves to a position where the protrusion can engage with the recess of the developer container.

2. A developer containing device comprising:

a developer container configured to contain developer and to be inserted into a receptacle defined in an image forming apparatus main body;

a developer feed inlet provided in the developer container and for feeding the developer contained in the developer container into the image forming apparatus main body; and an opening and closing member that opens the developer feed inlet with movement of the developer container in the insertion direction when inserts the developer container into the receptacle and closes the developer feed inlet with movement of the developer container in opposition to the insertion direction when the developer container is removed from the receptacle, the opening and closing member having a protrusion formed to protrude inward of the opening and closing member and allowed to engage with a recess provided in the developer container, and having a second protrusion in the rear end of the opening and closing member with regard to the insertion direction, formed to protrude inward of the opening and closing member, and being arranged to be allowed to move on the outside of the developer container in a direction intersecting with the insertion direction of the developer container, when the developer container is inserted into the receptacle, a developer container outside section sliding into the opening and closing member being relatively brought to one side of the opening and closing member in the direction intersecting with the insertion direction of the developer container, then the protrusion being released from the an engageable state, further comprising a protrusion provided in the forward end in the insertion direction of the developer container and formed to protrude toward at least the opposite side to the one side in the intersecting direction, wherein, when the developer container is inserted into the receptacle, the protrusion comes into contact with a protrusion provided in the receptacle, resulting in the opening and closing member being brought to one side in the direction intersecting with the insertion direction of the developer container and at least one side of the opening and closing member in the intersecting direction being pressed against the corresponding restrainer provided in the receptacle.

3. The developer containing device according to claim 1, wherein, the outside of the developer container, in the forward end of a section where the opening and closing member slides on with regard to the insertion direction, has a pawl formed to protrude outward in the direction intersecting with the insertion direction.

4. The developer containing device according to claim 1, wherein, a range within with the opening and closing member will move in the intersecting direction being wider than a range within which the protrusion of the opening and closing member engages with the recess of the developer container.

5. An image forming apparatus into/from which a developer containing device is installed and removed comprising:

an image forming apparatus main body in which a receptacle is defined; and a developer containing device that is removably installed in the image forming apparatus main body, the develop containing device including:

a developer container configured to contain developer and to be inserted in to the receptacle;

a developer feed inlet provided in the developer container and for feeding the developer contained in the developer container into the image forming apparatus main body; and an opening and closing member that opens the developer feed inlet with movement of the developer container in the insertion direction when the developer container is inserted into the receptacle and closes the developer feed inlet with movement of the developer container in opposition to the insertion direction when the developer container is removed from the receptacle, the opening and closing member having a protrusion formed to protrude inward of the opening and closing member and allowed to engage with a recess provided in the developer container, and having a second protrusion in the rear end of the opening and closing member with regard to the insertion direction, formed to protrude inward of the opening and closing member, and being arranged to be allowed to move on the outside of the developer container in a direction intersecting with the insertion direction of the developer container, when the developer container is inserted into the receptacle, a developer container outside section sliding into the opening and closing member being relatively brought to one side of the opening and closing member in the direction intersecting with the insertion direction of the developer container, then the protrusion being released from the an engageable state, when the opening and closing member moves to close the developer feed inlet, the rear end of the opening and closing member with regard to the insertion direction is pressed against the restrainers provided in the receptacle at least, and when the developer container is moved in opposition to the insertion direction with the developer feed inlet being opened by the opening and closing member, the protrusion moves to a position where the protrusion can engage with the recess of the developer container.

6. The developer containing device according to claim 1, wherein at least a center portion of the opening and closing member moves in the intersecting direction in response to the developer container being inserted into the receptacle.

7. The developer containing device according to claim 1, wherein at least a center portion of the opening and closing member moves in the intersecting direction within a range which is wider than a range within which the protrusion engages the recess.

8. The image forming apparatus according to claim 5, wherein at least a center portion of the opening and closing member moves in the intersecting direction in response to the developer container being inserted into the receptacle.

9. The developer containing device according to claim 1, wherein the entire opening and closing member moves in the intersecting direction in response to the developer container being inserted into the receptacle.

10. The developer containing device according to claim 2, wherein the entire opening and closing member moves in the intersecting direction within the range which is wider than the range within which the protrusion engages the recess.

11. The image forming apparatus according to claim 5, wherein the entire opening and closing member moves in the intersecting direction in response to the developer container being inserted into the receptacle.

* * * * *